US012359378B2

(12) United States Patent
Jamtgaard et al.

(10) Patent No.: US 12,359,378 B2
(45) **Date of Patent: *Jul. 15, 2025**

(54) ROADWAY INFRASTRUCTURE FOR AUTONOMOUS VEHICLES

(71) Applicant: Glydways Inc., South San Francisco, CA (US)

(72) Inventors: Peter Jamtgaard, Chelan, WA (US); Paul Jamtgaard, San Francisco, CA (US)

(73) Assignee: Glydways Inc., South San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/395,188

(22) Filed: Dec. 22, 2023

(65) Prior Publication Data

US 2024/0175217 A1 May 30, 2024

Related U.S. Application Data

(60) Continuation of application No. 17/541,106, filed on Dec. 2, 2021, now Pat. No. 11,885,076, which is a division of application No. 16/930,164, filed on Jul. 15, 2020, now Pat. No. 11,346,060.

(60) Provisional application No. 62/874,875, filed on Jul. 16, 2019.

(51) Int. Cl.
*E01C 1/00* (2006.01)

(52) U.S. Cl.
CPC ..... *E01C 1/002* (2013.01)

(58) Field of Classification Search
CPC ..... E01C 1/002
USPC ..... 404/1; 14/73–78
See application file for complete search history.

(56) References Cited

U.S. PATENT DOCUMENTS 121,374 A 11/1871 Jackson
1,252,873 A * 1/1918 Adams ..... E01D 6/00 14/74.5
2,225,186 A * 12/1940 Sorensen ..... E01D 2/00 404/1

(Continued)

FOREIGN PATENT DOCUMENTS

CN 202359503 8/2012
CN 108466939 A 8/2018

(Continued)

*Primary Examiner* — Raymond W Addie
(74) *Attorney, Agent, or Firm* — Brownstein Hyatt Farber Schreck, LLP

(57) ABSTRACT

An elevated roadway for autonomous vehicles may include a pylon extending vertically from a ground anchor and comprising a metal tube defining a central cavity and a concrete column within the central cavity. The elevated roadway further includes a bracket coupled to the pylon and comprising a mounting plate secured to the pylon and a cantilevered road support member extending from the mounting plate. The elevated roadway may further include a cantilevered road section coupled to the pylon via the cantilevered road support member and comprising a joist structure structurally coupled to the cantilevered road support member, a road member above the joist structure and supported by the joist structure, and first and second side barriers along first and second sides of the road member, respectively. The road member may be adapted to receive a four-wheeled roadway vehicle.

13 Claims, 14 Drawing Sheets

(56) References Cited

U.S. PATENT DOCUMENTS 2,416,054 A * 2/1947 Hobel ..... F15B 7/008 60/592
3,089,215 A 5/1963 Stubbs
3,257,764 A * 6/1966 Cripe ..... E01D 2/04 52/843
3,540,068 A * 11/1970 Bouthors ..... E01C 1/002 404/1
4,042,308 A 8/1977 Freedman
4,142,468 A * 3/1979 Birnstiel ..... E01B 2/003 404/1
4,282,619 A * 8/1981 Rooney ..... E01D 2/04 52/693
4,313,383 A 2/1982 Parazader
4,604,841 A 8/1986 Barnoff et al.
4,704,754 A 11/1987 Bonasso
5,231,931 A 8/1993 Sauvageot
5,471,694 A * 12/1995 Meheen ..... E01D 2/04 14/73
5,651,154 A 7/1997 Ahlskog
5,893,187 A * 4/1999 Fukuoka ..... E01D 19/04 14/77.1
5,987,680 A 11/1999 Sakaya
6,012,395 A 1/2000 Schulz
6,708,362 B1 3/2004 Allen
6,764,105 B1 7/2004 Sorkin
7,996,945 B2 * 8/2011 Nosker ..... E04F 15/105 14/73.1
8,316,495 B2 11/2012 He
8,925,132 B1 * 1/2015 Quinonez ..... E01D 2/02 14/77.1
2004/0197147 A1 10/2004 Kennedy
2005/0011148 A1 1/2005 Hwang
2005/0093190 A1 5/2005 Saddik
2006/0059636 A1 3/2006 Suggate
2006/0117504 A1 6/2006 Ronald
2009/0077758 A1 3/2009 Vincent
2009/0282626 A1 11/2009 Powers
2013/0263392 A1 10/2013 Han
2014/0345069 A1 11/2014 Tirimanna
2016/0340844 A1 11/2016 Revenew
2017/0218580 A1 8/2017 Eftekharzadeh
2017/0233960 A1 8/2017 Revenew
2019/0039615 A1 2/2019 Moulene

FOREIGN PATENT DOCUMENTS

CN 207878280 9/2018
CN 109235285 1/2019
CN 109518583 A 3/2019
DE 974 961 C 6/1961
GB 2143269 2/1985
GB 2397841 A * 8/2004 ..... E01C 1/002
JP 2006107405 A 4/2006
JP 2006112179 A 4/2006
JP 2009235829 10/2009
JP 2018066259 A 4/2018
JP 2019512417 A 5/2019
KR 101101209 B1 1/2012

* cited by examiner

ROADWAY INFRASTRUCTURE FOR AUTONOMOUS VEHICLES

CROSS-REFERENCE TO RELATED APPLICATIONS

This application is a continuation of U.S. patent application Ser. No. 17/541,106, filed Dec. 2, 2021, and titled "Roadway Infrastructure for Autonomous Vehicles," which is a division of U.S. patent application Ser. No. 16/930,164, filed Jul. 15, 2020, and titled "Roadway Infrastructure for Autonomous Vehicles," now U.S. Pat. No. 11,346,060, which is a nonprovisional patent application of and claims the benefit of U.S. Provisional Patent Application No. 62/874,875, filed Jul. 16, 2019 and titled "Roadway Infrastructure for Autonomous Vehicles," the disclosure of which is hereby incorporated herein by reference in its entirety.

FIELD

The described embodiments relate generally to roads for vehicles, and, more particularly, to separated grade (elevated) roadways for autonomous vehicles.

BACKGROUND

Vehicles, such as cars, trucks, vans, busses, trams, and the like, are ubiquitous in modern society. Cars, trucks, and vans are frequently used for personal transportation to transport relatively small numbers of passengers, while busses, trams, and other large vehicles are frequently used for public transportation. Vehicles may also be used for package transport or other purposes. Such vehicles may be driven on roads, which may include surface roads, bridges, highways, overpasses, or other types of vehicle rights-of-way.

SUMMARY

An elevated roadway for autonomous vehicles may include a pylon extending vertically from a ground anchor and comprising a metal tube defining a central cavity and a concrete column within the central cavity. The elevated roadway may further include a bracket coupled to the pylon and comprising a mounting plate secured to the pylon and a cantilevered road support member extending from the mounting plate. The elevated roadway may further include a cantilevered road section coupled to the pylon via the cantilevered road support member and comprising a joist structure structurally coupled to the cantilevered road support member, a road member above the joist structure and supported by the joist structure, and first and second side barriers along first and second sides of the road member, respectively. The road member may be adapted to receive a four-wheeled roadway vehicle. The mounting plate may be secured to the pylon via anchors embedded in the concrete column.

The concrete column may include steel-reinforced concrete. Either the metal tube or the concrete column may be capable of fully supporting a weight of the cantilevered road section. The joist structure may include a plurality of parallel joists. The plurality of parallel joists may include four parallel joists. The cantilevered road section may further include a metal form coupled to the joist structure and a concrete road support formed in the metal form, and the road member and the concrete road support may be parts of a monolithic structure.

A road section for an elevated roadway for autonomous vehicles may include a joist structure comprising a plurality of parallel joists, a metal form coupled to the joist structure, and a monolithic road structure including a road member and a plurality of road supports formed in the metal form and configured to transfer load from the road member to the joist structure. The joist structure may include four joists arranged in parallel. The joist structure may further include a plurality of inter-joist support members.

The joist structure may have a length of fifty feet or less. The joist structure may have a length of 33 feet or less. The road section may further include a water conduit extending substantially parallel to the plurality of parallel joists and configured to carry water from the road member to a water outlet. The joist structure may define a horizontal top plane and the plurality of road supports may have different heights to support the road member in a non-parallel orientation relative to the horizontal top plane.

The joist structure may be configured to be coupled to one or more additional joist structures to define a joist span, and the joist span may be configured to be supported by a first pylon at a first end of the joist span and a second pylon at a second end of the joist span. The joist span may have a length of 100 feet, and may be formed of two 50 foot joist structures, three 33 foot joist structures, or any other suitable combination of joist structures.

An elevated roadway for autonomous vehicles may include a plurality of pylons, each respective pylon of the plurality of pylons extending vertically from a respective ground anchor, and a cantilevered roadway supported by the plurality of pylons and defining, along at least a portion of the cantilevered roadway, a first side extending parallel to a direction of vehicular travel and a second side extending parallel to the direction of vehicular travel. Each pylon of the plurality of pylons may be positioned along the first side of the portion of the cantilevered roadway. The cantilevered roadway may be a first cantilevered roadway and the elevated roadway may further include a second cantilevered roadway supported by the plurality of pylons and positioned vertically above the first cantilevered roadway. The pylons may be set apart from one another by 100 feet or less. The cantilevered roadway may include a plurality of road sections joined end-to-end.

A pylon for an elevated roadway may include a metal tube defining a central cavity, a concrete column within the central cavity, and a first conduit at least partially embedded in the concrete column and defining an inlet proximate a top of the pylon and configured to receive water and an outlet proximate a bottom of the pylon and configured to eject water from the first conduit. The pylon may further include a second conduit at least partially embedded in the concrete column and configured to house a wire, the second conduit defining a first opening proximate the top of the pylon and a second opening proximate the bottom of the pylon. The pylon may be configured to support an elevated roadway.

The metal tube and the concrete column may define fully redundant load paths for supporting the elevated roadway. The concrete column may be reinforced with steel reinforcing members. The pylon may further include a reinforcement sleeve extending around a base portion of the metal tube. The pylon may further include a water reservoir within the reinforcement sleeve, and the outlet of the first conduit may be configured to eject water from the first conduit into the water reservoir.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
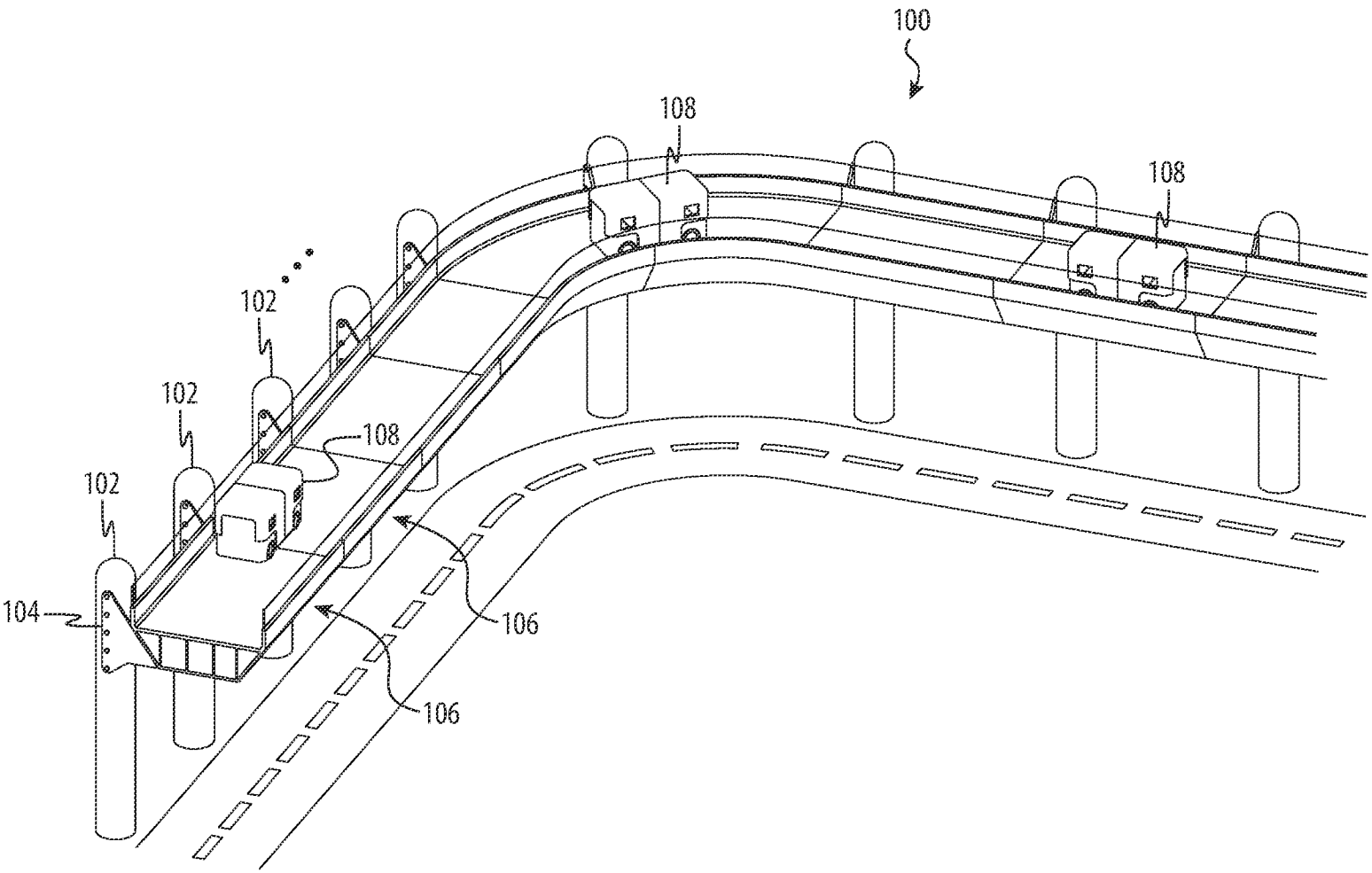
FIG. 1 depicts a portion of an example elevated roadway.

Reference will now be made in detail to representative embodiments illustrated in the accompanying drawings. It should be understood that the following description is not intended to limit the embodiments to one preferred embodiment. To the contrary, it is intended to cover alternatives, modifications, and equivalents as can be included within the spirit and scope of the described embodiments as defined by the appended claims.

The embodiments herein are generally directed to a transportation system in which numerous vehicles may be autonomously operated to transport passengers and/or freight along a roadway that includes elevated roadway segments. For example, a transportation system or service may provide a fleet of vehicles that operate along a roadway to pick up and drop off passengers at either pre-set locations or stops, or at dynamically selected locations (e.g., selected by a person via a smartphone). In some cases, it may be necessary or otherwise beneficial to elevate all or some of the roadway that the vehicles traverse. For example, in dense, urban environments, it may not be practical or desirable to devote existing traffic lanes or sidewalks to dedicated autonomous vehicle lanes. Accordingly, described herein are systems for elevating a roadway above ground level so that autonomous vehicle roadways may be provided while reducing or minimizing the impact on existing roads, sidewalks, and other infrastructure. As used herein, the term "roadway" may refer to a structure that supports moving vehicles. Separated grade roadways (also referred to herein as elevated roadways) for autonomous vehicles may include a series of pylons that are anchored into the ground and support the roadway. The roadway may be formed of multiple modular (and optionally at least partially prefabricated) road sections that are coupled to the pylons. Notably, the elevated roadways described herein may not be accessible to conventional roadway vehicles (e.g., cars, trucks, vans). Further, the vehicles that are used with the elevated roadways may be centrally controlled or otherwise programmed to operate according to a particular set of rules. Accordingly, the maximum loading of the elevated roadways may be a known or at least highly controllable quantity. By contrast, conventional roadways and bridges must be designed to accommodate an unknown worst-case loading scenario that includes vehicles of different sizes, weights, speeds, and the like. Because the loading of the elevated roadways of the transportation system described herein can be highly controlled, and also because the vehicles of the transportation system are relatively small and light compared to conventional road-going vehicles, the elevated roadways described herein may be smaller and lighter than a conventional bridge or highway span.

As noted above, the elevated roadway may include a series of modular roadway sections that are supported above the ground by a series of pylons. The roadway sections may include a joist structure that can be at least partially manufactured remotely (e.g., prefabricated) and shipped to an installation site, where it may be coupled with other joist structures and ultimately raised and coupled to the pylons. The joist structures may be formed of multiple individual joists that may be sized so they can be shipped using conventional shipping methods. For example, the joists may be configured to fit in land-sea-air containers, on flatbed semi-trucks, or the like. In some cases, multiple joists may be fitted into a single land-sea-air container or on a trailer of a semi-truck. The multiple joists may then be coupled together to form a joist structure, which may then be combined (e.g., end-to-end) with other joist structures and then coupled to the pylons. Because of the modular, prefabricated nature of the joists, as well as their ability to be transported using conventional shipping methods such as land-sea-air containers and semi-trucks, deployment of the elevated roadway may be faster and more efficient than conventional road construction methods.

Once elevated and coupled to the pylons, concrete road structures may be built on top of the joist structures to define the actual wearing surface of the roadway (e.g., the surface that the vehicle tires contact). The road structures may be built on top of the joist structures by attaching forms (e.g., molds that define the shape of the road structure) to the joists, and filling the forms with a concrete deposition machine. Notably, the road structures need not be simple flat, planar slabs that sit atop the joist structures. Rather, the road structures may define curves, banks, inclines, declines, or other shapes in addition to basic flat slabs. In this way, though the road structures may all be monolithic concrete structures, they may have unique shapes that cooperate to define the straights, curves, hills, and banks of the road structures. Additional details about the road structures and techniques for forming them are described herein.

As noted above, the roadway may be part of a transportation system that includes or operates with a dedicated type of vehicle (or several dedicated types of vehicles), which may be configured to independently operate according to known rule sets or control schemes, and which may also be subject to being directly controlled or guided by a supervisory control system. As used herein, "vehicle control schemes" may refer to control schemes that are executed by an individual vehicle (also referred to as "local control schemes"), as well as central and/or distributed control schemes that may have the ability to control multiple different vehicles (which are also referred to as "supervisory control schemes"). It will be understood that vehicle control schemes may include elements of both local and supervisory control schemes to control the vehicles such that there may not be (and need not be) a clear or well-defined functional or programmatic boundary between the local and supervisory control schemes.

Because the transportation system and its vehicles are typically limited to autonomous vehicles (e.g., there are typically no human drivers independently piloting the vehicles), and more particularly to known types of vehicles, the shape and contour of the road structures may be designed in concert with the vehicles and the vehicle control schemes. For example, because the specifications of the vehicles are known (e.g., maximum speed, turning radius, maximum braking performance, acceleration capabilities, etc.), the roadway may be designed in concert with the vehicle specifications to produce a target ride characteristic and to achieve an overall vehicle and roadway performance.

Further, autonomously controlling vehicles using the vehicle and supervisory control schemes allows a greater range of roadway shapes and contours to be used. For example, while it may be necessary to avoid building small-radius turns in a conventional highway (because it would be unsafe to require human drivers to make drastic speed and direction changes), such turns may be feasible in the instant system. In particular, because the entire roadway is known to the transportation system, all of the vehicles on the roadway may be specifically configured to make appropriate speed adjustments and steering movements to safely and comfortably navigate the roadway, even if there are sharp turns, banked turns, inclines, declines, or the like that would otherwise be too dangerous or inconvenient on conventional roadways.

In some cases, the transportation system may be designed to result in a particular ride characteristic for occupants when the vehicles are traversing the roadway. As used herein, "ride characteristic" may refer to a set of physical parameters (such as forces or accelerations) that are experienced by an occupant of a vehicle traversing along the roadway. In some cases, the ride characteristic may be characterized by a set of target values or upper limits or thresholds (e.g., on lateral and vertical acceleration) that will be experienced by an occupant while travelling over the roadway in a vehicle (e.g., the system may be configured to maintain the acceleration forces experienced by vehicle occupants at or below threshold levels). As one specific example, the accelerations felt by a user may be limited in fore, aft, and lateral directions to less than 0.5 times the force of gravity (g), while vertical acceleration may be maintained between 0.5 g and 1.5 g. (These acceleration limits may be established for a location within the vehicle where a passenger's head would be during normal vehicular travel.) Other kinematic properties may also be subject to targets, upper limits, or thresholds. For example, in addition to or instead of acceleration, the transportation system, and in particular the shape of the roadway, may be designed so that velocity, jerk, and snap may all be maintained at or near target values, or at or below limits or threshold values. Further, to provide a consistent experience, these targets and/or limits may be applied along the entire or substantially the entire roadway. By designing the roadway (e.g., the turns, inclines, declines, banks, camber, etc., of the roadway) to achieve a target ride characteristic, passengers may experience the sensation of gliding, without the abrupt and varying lateral, fore/aft, and vertical acceleration changes that occur when travelling along a conventional road.

The foregoing threshold values for acceleration are merely exemplary values, and other values or ways of quantifying the target ride characteristics are also contemplated. Notably, as described above, these ride characteristics may be maintained even along roadways that include highly-banked turns, steep inclines or declines, small-radius turns, and the like. For example, the vehicles may be programmed to traverse these roadway features in a way that maintains the desired ride characteristics. Indeed, as described herein, the vehicles may include features such as four-wheel steering and four-wheel independently adjustable suspension (including adjustable ride heights, preloads, damping, etc.) that may be used to help maintain the target ride characteristics along various types of roadway features, shapes, and configurations.

FIG. 1 illustrates a section of an example elevated roadway 100 for autonomous vehicles 108, in accordance with embodiments described herein. The section of elevated roadway that is shown in FIG. 1 is alongside and/or above a conventional surface road, illustrating the elevated roadway deployed in a typical urban or suburban environment, though this is not meant to be limiting. Indeed, the elevated roadway may be deployed in any environment or location, including rural locations, entirely or partially inside buildings, away from roadways, underground, or the like. The elevated roadway 100 is shown supporting a plurality of four-wheeled vehicles 108. The vehicles 108 may be autonomous or semi-autonomous vehicles specifically designed for use with the elevated roadway 100. One example type of vehicle for use with the elevated roadway 100 is described with respect to FIGS. 12A-14B, though other types of vehicles may be driven along the elevated roadway 100 instead of or in addition to those described herein.

The elevated roadway is supported by a plurality of pylons 102 that extend vertically from a ground anchor; in some embodiments, each section of the elevated roadway 100 may be affixed to its own pylon 102, while in other embodiments each section of the elevated roadway 100 may be affixed to multiple pylons. The pylons 102 may be spaced apart by any suitable distance. In some cases, the pylons 102 are spaced apart by about 100 feet (thus defining roadway spans of about 100 feet). The spacing of the pylons 102 may be defined by or consistent with the dimensions of standardized-length road sections that are used to form the elevated roadway 100. For example, road sections may have a standardized length of about 33 feet to allow the sections (or at least the joists of the road sections) to be at least partially prefabricated (remotely) and shipped to the build site in land-sea-air containers, or about 50 feet to allow them to be shipped by semi-trucks. Accordingly, the 100-foot distance between joists allows the roadway spans to be formed of either three 33-foot road sections or two 50-foot road sections. The standardization of the pylon spacing and joist length simplifies design and construction logistics, as the pylon spacing can be standardized even across regions with different shipping constraints.

The distance between pylons 102 may be generally uniform along the length of an elevated roadway 100. For example, all or most of the pylons 102 may be spaced about 100 feet apart from one another. The uniform spacing may help simplify the design and construction of the elevated roadway 100. Nevertheless, in some cases it may be necessary or beneficial to have a different spacing between pylons, such as where the roadway curves or turns, or to accommodate buildings, obstacles, or other features along the path of the elevated roadway 100. In some cases, where the distance between pylons is other than 100 feet, the distance may be 33 feet or 50 feet (or any additive combination of these distances) so that the standardized road sections can be used. In other cases, customized road sections having other lengths may be provided to accommodate any suitable distance between pylons 102.

Each pylon 102 may include a bracket 104 that is secured to the pylon 102 and supports one or more cantilevered road sections 106. The elevated, cantilevered arrangement of the road sections 106 may provide several advantages over other types of elevated bridges or highway spans. For example, because the road sections 106 need only be supported along one side, the pylons 102 may be positioned along whichever side of the road sections 106 is most advantageous based on construction constraints, space considerations, or the like. Further, because the road sections 106 are cantilevered from the pylons 102, the entire width of the road sections 106 may define an unobstructed covered path that can be used for covered sidewalks, roads, and the like. By contrast, roadways that are directly on top of their pylons (e.g., centered over the pylons), the path defined beneath the roadway is inconveniently interrupted by the pylons. Additionally, because the road sections 106 can be cantilevered from the pylons 102, multiple road sections 106 may be supported on a single pylon 102. For example, as described in greater detail with respect to FIGS. 9A-9D, multiple road sections 106 may be easily supported by a single pylon 102. Such configurations may not be possible if each road section needed to be positioned on top and/or centered over a pylon.

Figure 2:
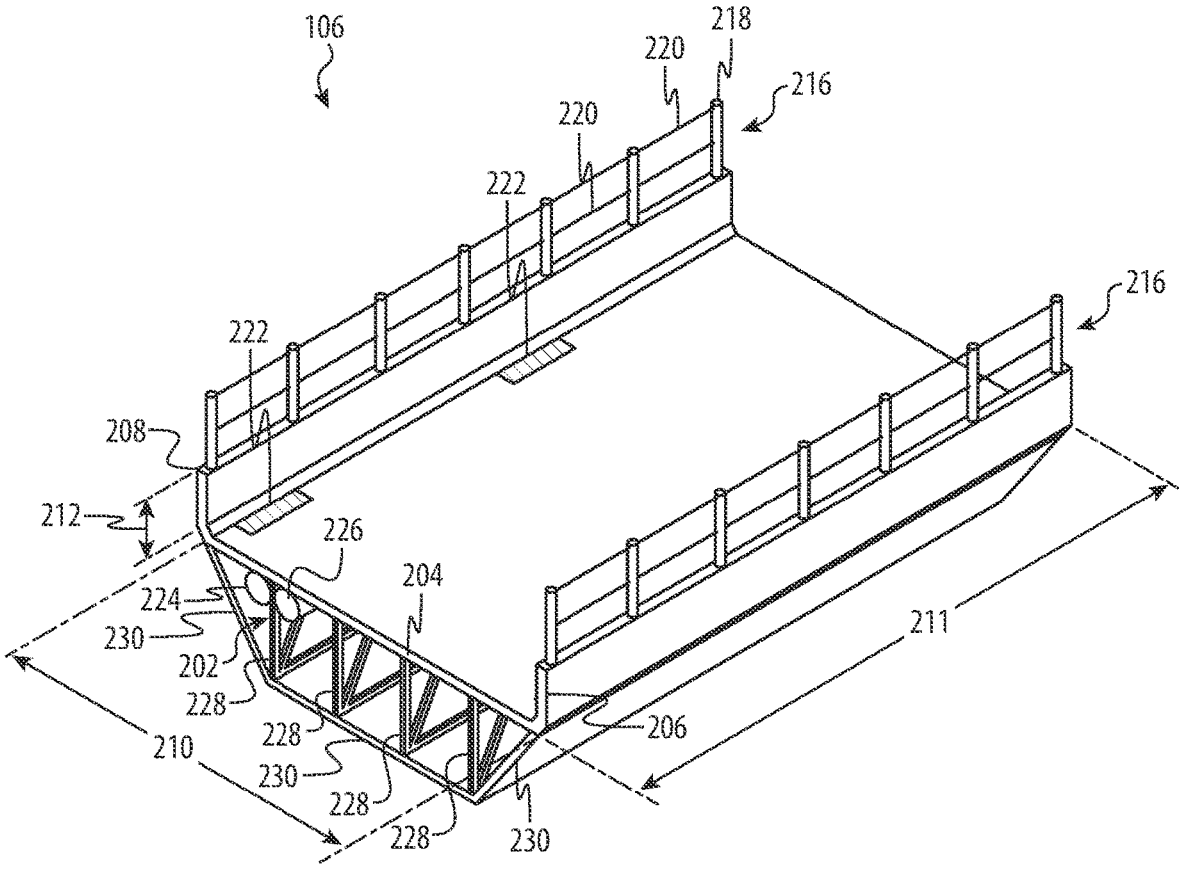
FIG. 2 depicts an example road section of the elevated roadway of FIG. 1.

FIG. 2 illustrates an example road section 106 of the elevated roadway 100. The road section 106 may include a joist structure 202, a road member 204 above the joist structure 202 and supported by the joist structure 202, and first and second side barriers 206, 208 along first and second sides of the road member 204. The road section 106 shown in FIG. 2 may be a standardized structure, such that many identical or similar instances of the road section 106 may be joined together and supported by pylons to produce the elevated roadway shown in FIG. 1.

The road member 204 may be adapted to receive and/or support a four-wheeled roadway vehicle, such as the vehicles 108 (FIG. 1), 1200 (FIGS. 12A-13B), and 1400, 1420 (FIGS. 14A-14B) described herein. A "four-wheeled roadway vehicle" may refer to a wheeled vehicle that can move under its own power and freely maneuver along the roadway (e.g., without a track, rail, or other physical-contact based guide mechanism). The road member 204 may also be adapted to receive and/or support other types of vehicles, including vehicles with different numbers of wheels (e.g., one wheel, two wheels, three wheels, or more than four wheels), construction vehicles, four-wheeled roadway vehicles that are adapted for non-passenger use (e.g., for carrying cargo or other payloads), emergency vehicles (e.g., autonomous or human-operated police cars, ambulances, firetrucks, etc.), or the like.

The road member 204 may be made of or include concrete or any other suitable paving material (e.g., asphalt, bituminous road). Also, the road member 204 may lack rails or other mechanical guides that physically steer or guide the vehicles. Accordingly, the road member 204 may define a substantially flat or featureless surface that allows vehicles to freely drive and navigate along the roadway. The road member 204 may have any suitable dimensions to accommodate the vehicles for which the transportation system is designed. For example, the road member 204 may have a length dimension 211 that corresponds to and/or is based on the length of the joist sections (which may be standardized to 50 feet or 33 feet, as described above, or may be any other suitable length). The road member 204 may also have a width dimension 210 of 130 inches (or any other suitable width). The width dimension 210 may be configured to allow two vehicles to ride abreast or to pass each other on the roadway. For example, the width dimension 210 may be at least twice the width of the vehicles, plus an additional safety margin (e.g., allowing 12 inches between vehicles and between vehicles and the side barriers). The road member 204 may also include systems and/or components embedded in or otherwise attached to the road member 204 to assist in vehicle navigation along the roadway. For example, markers that are visible and/or electronically detectable by vehicles may be embedded in and/or attached to the road member 204. Such markers may help the vehicle steer along a desired path, inform the vehicle where it is on the road member 204 (and where it is along the roadway more generally), allow the vehicle to determine speed and/or other motion parameters, or the like. In some cases the markers are magnets or magnetic materials (e.g., steel, iron) that are embedded in the material of the road member 204.

The side barriers 206, 208 may be formed of or include concrete, and may be integrally formed with the road member 204. For example, the side barriers 206, 208 and the road member 204 may define at least part of a monolithic road structure that is formed by pouring or molding concrete into one or more metal forms. Road supports (e.g., road supports 405, 415, FIGS. 4A-4B) may also be part of the monolithic road structure that also forms the road member 204 and the side barriers 206, 208. The road member 204, side barriers 206, 208, and the road supports may include reinforcing materials embedded in or attached to the concrete, such as rebar, straps (e.g., metal straps), bars, beams, brackets, or the like. As used herein, "rebar" may refer to steel reinforcement bars that may be at least partially embedded in or attached to a matrix material (such as concrete) to provide structural reinforcement to the matrix material. The side barriers 206, 208 may have a height 212 above the road member 204. The height 212 may be selected at least in part based on the size and configuration of the vehicles that will ride on the roadway.

Because the side barriers 206, 208 are integral with the road member 204, the road sections may define a continuous trough-like structure that prevents or limits water, debris, or other objects from falling off of the elevated roadway onto the ground or other underlying objects. To help remove rain water or snow melt (or other precipitation) from the road member 204, the road sections may include openings 222 in the road member 204 (which may be covered by grates) that communicate with one or more conduits 224 below the road member 204. The conduits 224 may extend parallel to the joists that support the road member 204 and may carry water from the road member 204 to a water outlet of the roadway. Water outlets may be integrated with the pylons and may be above, at, or below ground level. For example, the water outlets may drain to water detention planter boxes that are integrated into reinforcement sleeves around the base of the pylons (e.g., above grade), bioswales or basins on-grade, or directly into a storm system (e.g., a municipal storm system) below grade.

The conduits 224 may also act as water reservoirs in case of clogged or blocked outlets or storm drain overflow. Accordingly, the conduits 224 may be configured to have a particular internal volume that meets or exceeds any applicable storm water retention regulations, standards, and/or engineering best practices. In some cases, the roadway may include other reservoirs to supplement the volume of the conduits 224 themselves. Additional details of water outlets are described herein with respect to FIG. 6.

The road section 106 may also include fencing 216 extending above (and optionally extending from a top surface of) the side barriers 206, 208. The fencing 216 may include fence posts 218 supporting one or more cables 220 sufficient to comply with prevailing building codes and safety requirements. The fence posts 218 may be secured to the side barriers 206, 208 to provide structural support for the fencing 216. For example, the fence posts 218 may be at least partially embedded in the concrete of the side barriers 206, 208 (and thus embedded in or part of the monolithic road structure), bolted to the side barriers 206, 208, or otherwise secured to the side barriers 206, 208. The fencing 216 may have sufficient size and strength to arrest a fully loaded vehicle travelling at a target speed (e.g., a maximum planned vehicle speed, with a suitable additional margin). Accordingly, in the unlikely event of a collision between a vehicle and the side barriers 206, 208 and the fencing 216, the vehicle may be safely contained on the roadway.

The fencing 216 may also be adjustable to different heights above the side barriers 206, 208. The adjustability of the fencing height may facilitate or enable several features. For example, the fencing 216 may be positioned at different heights along different segments of the roadway, such as higher along the outside of a turn or in environments where additional fencing height is necessary or desirable. As another example, the fencing 216 may be used for worker safety during construction and/or maintenance of the elevated roadway. Fencing for worker safety may have different requirements than fencing for roadway safety. Accordingly, the adjustable fencing allows the fencing to be positioned at a first level during construction and commissioning of the roadway (e.g., when workers may be on the road member), and at a second level (which may be lower than the first level) when the roadway is being used for vehicle traffic. The fencing 216, including the fence posts 218, cables 220, or both) may also be designed so that it can be used as a tie-off point for safety harnesses. More particularly, the fencing 216 may have sufficient strength ratings to meet or exceed fall protection safety standards (e.g., which may be applicable during construction and/or maintenance of the elevated roadway).

The roadway may also include one or more additional conduits 226 for routing or otherwise carrying other materials, such as wiring, along the roadway. Wires from the additional conduits 226 may provide power and/or communications to devices along the roadway. Such devices may include, without limitation, lighting, sensors (e.g., for sensing vehicles, traffic, weather or environmental conditions), communications equipment, or any other types of electronic equipment. While one additional conduit 226 is shown, there may be any number of additional conduits supported by the roadway. The additional conduits may also be unrelated to the function of the roadway or transportation system. For example, electrical, water, telecommunications, natural gas, or other utilities may be routed in additional conduits that are supported by the roadway.

As noted above, the road member 204 may be on top of and supported by a joist structure 202. The joist structure 202 may include multiple parallel joists 228 (e.g., four parallel joists 228). The joists 228 may be formed of any suitable material, such as steel, and may have any suitable shape and/or configuration. The parallel joists 228 may be connected to one another via inter-joist cables, braces, or other structures. The parallel joists 228 may also be formed of or include multiple joist sub-sections joined end-to-end to define a single joist. Thus, for example, each of the four parallel joists 228 may be formed of or include one, two, three, four, or more joist sub-sections. The connected parallel joists 228 may constitute the joist structure of one of the road sections 106. As described herein, the joist structures of the road sections may be coupled to one another end-to-end to define a continuous roadway. This may include coupling the free ends of the joists of one road section to the free ends of the joists of another road section.

The road section 106 may also include wall sections 230 that may cover the joist structures 202. The wall sections 230 may be load-bearing or non-load bearing, and may prevent or limit access to the internal structures of the roadway by objects, animals, and individuals. The wall sections 230 may be removable and/or movable, however, to allow access to the joist structures, conduits, or other internal structures or components for construction, maintenance, or other purposes. The wall sections 230 may be formed from or include any suitable materials, including but not limited to metal, plastic, reinforced polymers, wood, glass, or the like.

Figure 3:
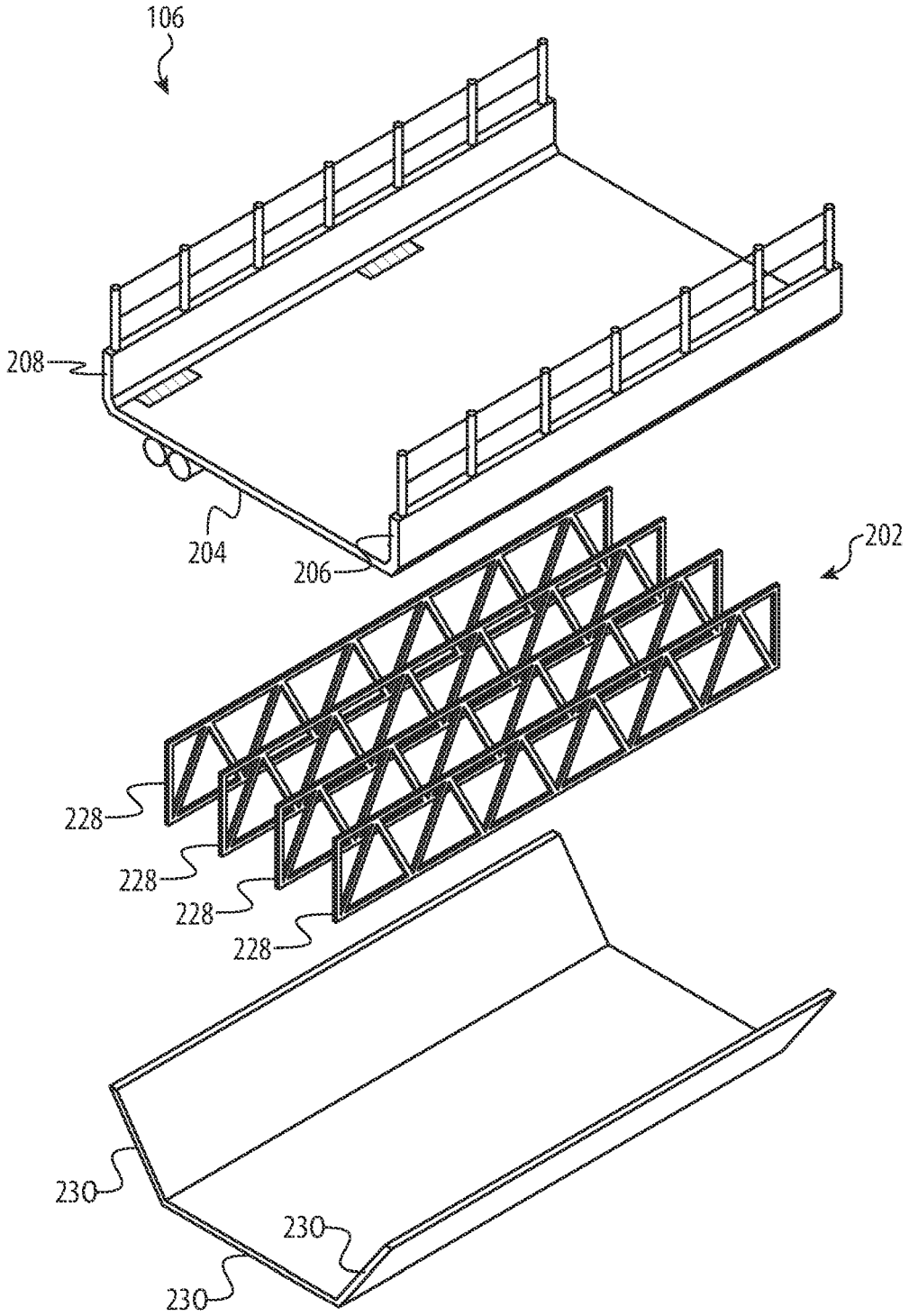
FIG. 3 depicts an exploded view of the road section of FIG. 2.

FIG. 3 is an exploded view of the road section 106 of FIG. 2. The exploded view illustrates the parallel joists 228 that form the joist structure 202, as well as the monolithic road structure (including the road member 204 and the side barriers 206, 208) that is supported by the joist structure 202, and the wall sections 230. As shown, the parallel joists 228 resemble parallel chord trusses (e.g., Warren trusses), though any other suitable joist or truss design may be used. As described herein, the road member 204 and side barriers 206, 208 may be formed in-place after the joist structure 202 is built, raised, and coupled to the pylons.

Figure 4A:
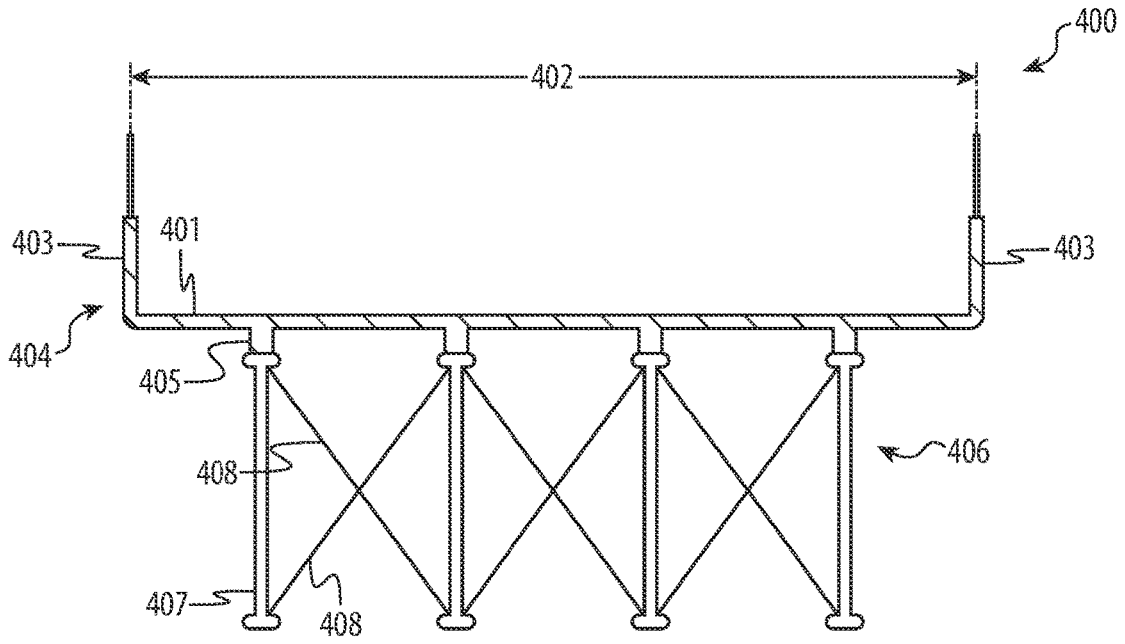
FIGS. 4A-4B are partial cross-sectional views of example road sections for an elevated roadway.
Figure 4B:
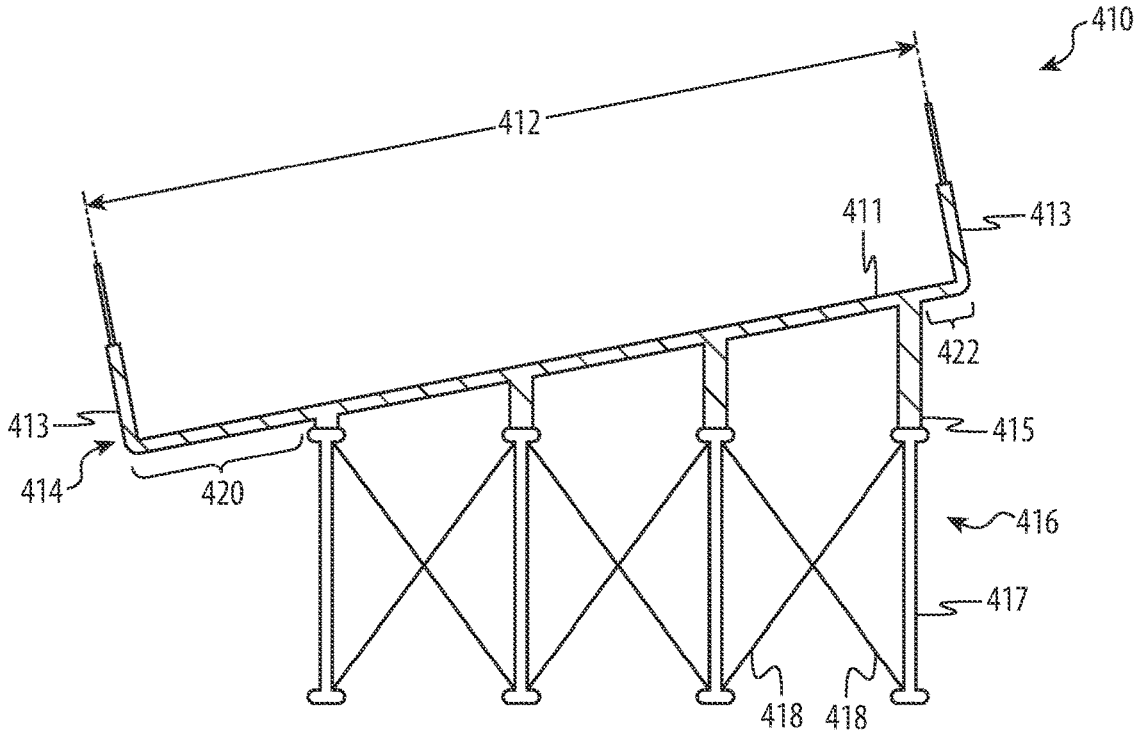

FIGS. 4A-4B illustrate partial cross-sections of two example road sections 400, 410, respectively. FIGS. 4A and 4B illustrate how various differently shaped road members may be formed on top of the same joist structure.

FIG. 4A illustrates an example of a road section 400 that defines a straight and level wearing surface. The road section 400 may include a monolithic road structure 404 (defining a road member, sidewalls and fencing, as described above) that is formed on top of and supported by a joist structure 406. The joist structure 406 may include multiple parallel joists 407, as well as inter-joist members 408. The monolithic road structure 404 may be formed by attaching forms (e.g., metal molds) to the joist structure 406, where the forms define some or all of the shape of the monolithic road structure 404. Once the forms are in place, reinforcing materials (e.g., rebar, steel-fiber mesh, etc.) may be positioned in and/or above the forms, and concrete may be poured into the forms to encapsulate the reinforcing materials and ultimately form the monolithic road structure 404. In some cases, reinforcing materials such as reinforcing fibers may be mixed or otherwise incorporated into the concrete before the concrete is poured or otherwise deposited to form the monolithic road structure 404. The concrete may be a high-strength concrete with a compressive strength in a range of about 4-10 ksi, in some cases about 6 ksi. The forms may remain in place to add additional structural strength and/or support to the monolithic road structure 404. In other cases, the forms may be removed after the concrete is hardened.

The monolithic road structure 404 may define a road member 401, side walls 403, and road supports 405. The road supports 405 may be part of the monolithic road structure (e.g., integral with the road member 401 and side walls 403), and may transfer load from the road member 401 to the joist structure 406. The shapes and sizes of the road supports 405 in any given road section may be selected to result in a desired attitude of the wearing surface. For example, as shown in FIG. 4A, there are four road supports 405, each positioned on top of or otherwise being supported by a respective joist. The road supports 405 are all of the same height, resulting in the wearing surface of the road member 401 being parallel to a horizontal top plane defined by the joist structure 406 (e.g., the road member 401 defines a straight and level surface). FIG. 4B illustrates another configuration of road supports that support a road member 411 in a non-parallel orientation relative to a horizontal top plane defined by the joist structure 416 (e.g., the road member 411 is canted or banked).

FIG. 4B illustrates an example of a road section 410 that defines a banked road member. Similar to the road section 400 in FIG. 4A, the road section 410 may include a monolithic road structure 414 (defining a road member, side walls and fencing, as described above) that is formed on top of and supported by a joist structure 416. The joist structure 416 may include multiple parallel joists 417, as well as inter-joist members 418. The monolithic road structure 414 may be formed by attaching forms (e.g., metal molds) to the joist structure 416 and forming the monolithic road structure 414 in the forms using concrete and reinforcing materials, as described above.

The monolithic road structure 414 may define a road member 411, side walls 413, and road supports 415. Whereas the monolithic road structure 404 defined a horizontal wearing surface, the road member 411 may be pitched to define a pitched or banked wearing surface. The pitched road member 411 may define a portion of a banked turn section of the roadway. In order to produce the pitched road member 411, the road supports 415 may have differing heights to produce the desired wearing surface angle. In this way, the same joist structures can be used to support numerous different road member configurations, orientations, and/or attitudes. More particularly, the same joist structures can be used for forming straight and level road sections, as well as banks, curves, hills, or other road profiles. In this way, the joist structures may be highly modular so that complex road profiles may be produced by forming multiple differently shaped monolithic road structures on top of standardized, uniform joist structures.

The road supports 415 (and road supports 405, FIG. 4A) may be continuous along the length of the monolithic road structures (e.g., continuous into the page), and thus may resemble elongated beam-like structures. In other examples, the road supports resemble pillars, and a series of pillars extends along and is supported by each joist structure to support the road member.

The road sections 400, 410 may both have substantially the same width. For example, the width dimensions 402 (FIG. 4A) and 412 (FIG. 4B) may be the same. Because the monolithic road structures can be molded into many different shapes and configurations, the position of the monolithic road structures relative to the joist structures need not be uniform. For example, in FIG. 4A, the monolithic road structure 404 is centered above the joist structure 406. By contrast, in FIG. 4B the monolithic road structure 414 is off-center above the joist structure 416. More particularly, the monolithic road structure 414 defines a first overhang 420 that is greater than a second overhang 422 on the opposite side of the roadway. By allowing the joist structures to be off-center from the monolithic road structures, greater design flexibility is achieved because a larger range of road profiles, turns, banks, or other shapes or features can be provided using a uniform, modular joist structure (e.g., without having to modify or customize the joist structure for each road section).

Figure 5:
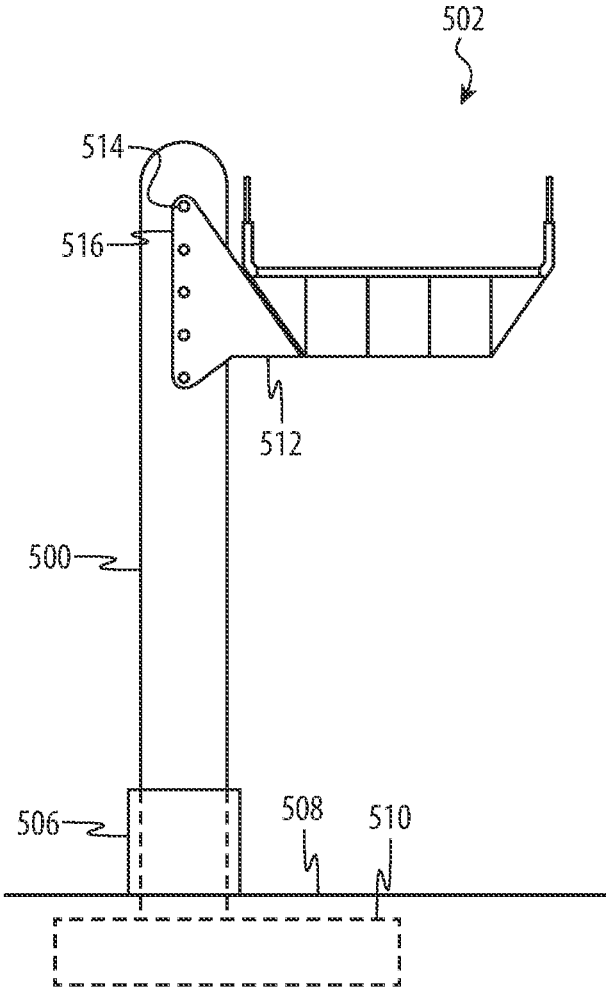
FIG. 5 depicts a cantilevered road section supported by a pylon.

FIG. 5 illustrates a cantilevered road section 502 supported in an elevated position by a pylon 500 that extends vertically from a ground anchor 510. FIG. 5 further illustrates the cantilevered configuration of the road sections, demonstrating how the road sections need only be supported along one side, and how the road sections need not be supported from directly below (e.g., centered below) the road sections.

The road section 502 may be coupled to the pylon 500 by a bracket 512 or any other suitable connector. For example, and as described herein, the bracket 512 may include a mounting plate 516 that is secured to the pylon 500 by anchors 514. The anchors 514 may be rods, bolts, bosses, or any other suitable mechanism by which a bracket 512 may be attached to the pylon 500.

The pylon 500 may be secured to a ground anchor 510 (or, in some embodiments, the ground anchor may be part of the pylon). The ground anchor 510 may be formed of or include reinforced concrete that is formed in-place or otherwise positioned below ground level 508. A reinforcement sleeve 506 may be formed about the base of the pylon 500. The reinforcement sleeve 506 may be formed from or include a metal (e.g., steel) sleeve or jacket that surrounds a base of the pylon 500. In some cases, the reinforcement sleeve 506 is formed from or includes concrete. In some cases, the reinforcement sleeve 506 includes a metal sleeve with concrete formed inside the metal sleeve and around the base of the pylon. Other configurations are also possible. For example, the reinforcement sleeve 506 may include various types of energy-absorbing materials between an outer sleeve member (e.g., a metal tube) and the pylon 500. Such materials include without limitation foam, metal energy-absorbing structures, liquid (e.g., water), or the like.

Reinforcement sleeves 506 may be at least partially hollow or otherwise define internal volumes or chambers. The internal volumes of the reinforcement sleeves 506 may be used for water retention purposes. For example, water conduits that carry water away from a road surface may extend through the pylon 500 and exit into or through the internal volumes of the reinforcement sleeves 506. Accordingly, if the amount of water that needs to be removed from a road surface exceeds the capabilities of the water outlet (e.g., if the volumetric flow rate of the water on the road surface exceeds the volumetric flow rate capability of the water outlet), water can temporarily back-up into the internal volumes and drain out in due course.

The reinforcement sleeve 506 may be configured to help prevent or mitigate damage to the pylon 500 in the event of an impact. For example, pylons 500 may be positioned along or near a conventional surface road where vehicles may collide with the pylons in the case of accidents. Accordingly, the reinforcement sleeve 506 may help absorb and/or dissipate energy from vehicles and minimize or eliminate structural damage to pylons 500.

Figure 6:
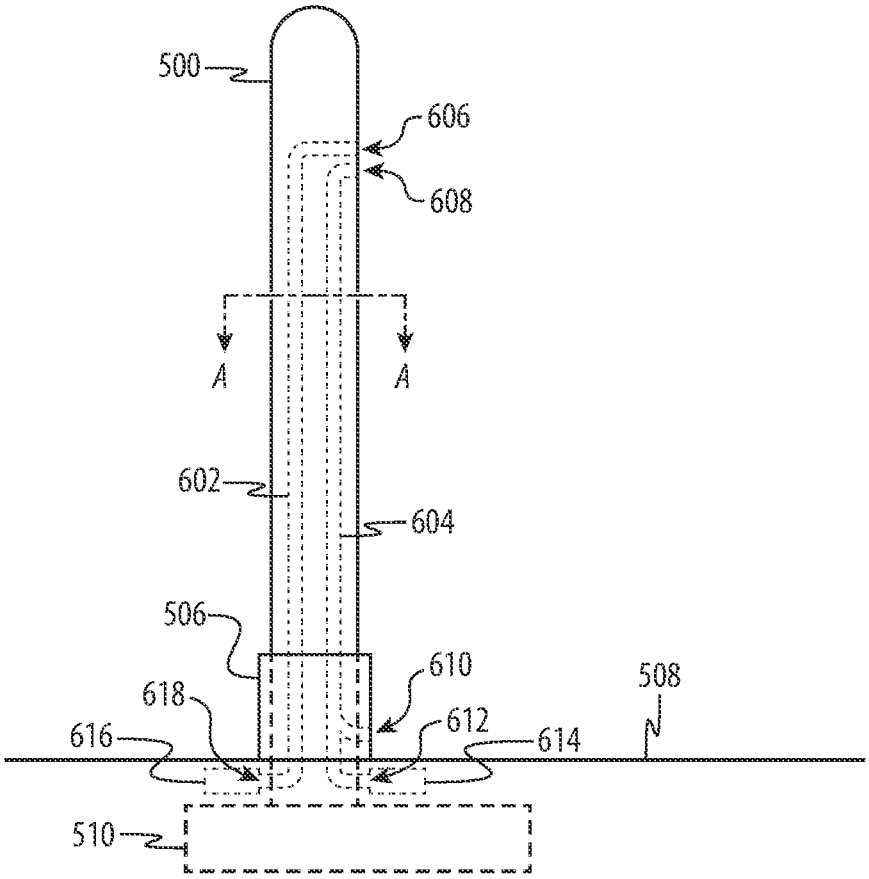
FIG. 6 depicts the pylon of FIG. 5.

FIG. 6 illustrates additional details of the pylon 500, and in particular how conduits may be at least partially embedded in the pylon 500 to carry water, wires, pipes, or other objects between a road surface and the ground. The pylon 500 includes a first conduit 602 and a second conduit 604 (though this is merely exemplary, and the pylon 500 may include more, fewer, or different conduits). The first conduit 602 may define an inlet 606 proximate the top of the pylon 500, and an outlet 618 proximate the bottom of the pylon 500. The second conduit 604 similarly includes an inlet 608 proximate the top of the pylon 500 and one or more outlets 610, 612 proximate the bottom of the pylon 500.

The second conduit 604 may be configured to receive water from a road section (e.g., via a water conduit 224, FIG. 2), carry the water downward through the pylon 500, and eject the water out of the second conduit 604. In some cases, the second conduit 604 may eject the water from the outlet 610 directly onto a road, gutter, or other exposed ground surface. In implementations where the reinforcement sleeve 506 includes or defines internal reservoirs, the second conduit 604 may eject water from the outlet 610 into those reservoirs.

Instead of or in addition to ejecting water above ground level (e.g., from the outlet 610), the second conduit 604 may eject water below ground level. For example, FIG. 6 shows the outlet 612 coupled to an underground channel, such as a storm sewer 614. The storm sewer 614 may carry water ejected from the second conduit 604 to a treatment facility or other water receiving infrastructure. The storm sewer 614 may be provided by a municipality or utility and may receive water from other streets, roads, buildings, and the like. In other embodiments, a drainage field may accept water from one or more conduits in one or more pylons.

The first conduit 602 may be configured to house one or more wires that extend from the elevated roadway to the ground level. For example, the first conduit 602 may house wires for lighting, sensors (e.g., for sensing vehicles, traffic, weather or environmental conditions), communications equipment, or any other types of electronic equipment. The first conduit 602 may also house other items such as pipes for natural gas, water, or the like. The wires and/or pipes may extend into an underground channel 616. The underground channel 616 may extend for any suitable distance and may join with other underground channels to facilitate routing of the wires and/or pipes to other locations such as control panels, buildings, other pylons, utility providers, telecommunication providers, or the like.

Figure 7:
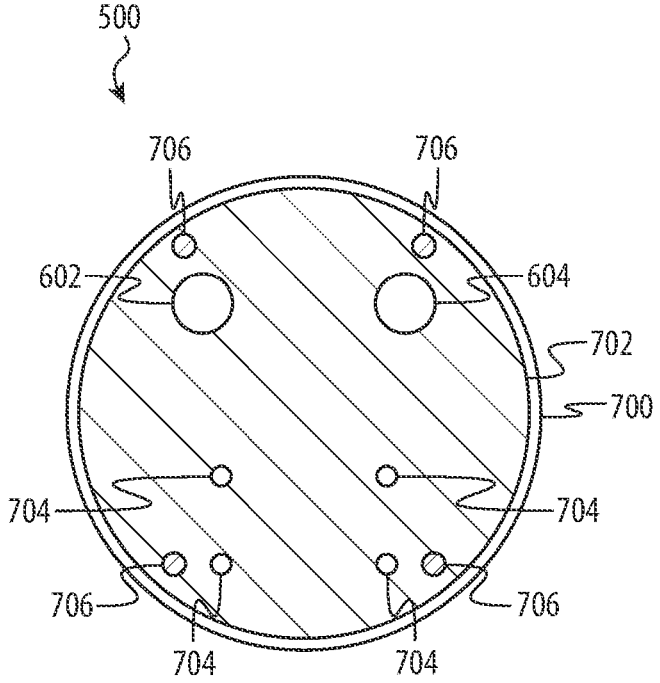
FIG. 7 is a partial cross-sectional view of the pylon of FIGS. 5 and 6.

FIG. 7 is a cross-sectional view of the pylon 500, viewed along line A-A in FIG. 6. The pylon 500 may include a metal tube 700 that defines a central cavity. The cavity may be filled with concrete to produce a concrete column 702 that provides additional strength and durability to the pylon 500. Either the metal tube 700 or the concrete column 702 alone may provide sufficient strength to fully support the weight of the cantilevered roadway. This may provide several benefits. For example, the metal tubes 700 of the pylons 500 may be installed and the roadway may be erected prior to the metal tubes 700 being filled with concrete. This may facilitate more rapid and cost-effective deployment of the elevated roadway, as road sections may be coupled to the pylons as soon as the metal tubes 700 are erected. Furthermore, the elevated roadway may be made fully operational without the metal tubes 700 being filled with concrete. In this way, the elevated roadway and the overall transportation system of which it is a part may be tested, validated, and used before the pylons are filled with concrete.

As noted above, the pylon 500 may include conduits that extend through the interior of the pylon. FIG. 7 illustrates the first and second conduits 602, 604 embedded in the concrete column 702. FIG. 7 also illustrates additional conduits 704 (which may be the same as or similar to the first and second conduits 602, 604). The conduits that are embedded in the concrete column 702 may have sufficient strength to resist crushing or deformation when the metal tube 700 is filled with concrete.

The concrete column 702 may also include reinforcing members 706, such as rebar or any other suitable reinforcement material or component. In some cases, the reinforcing members 706 extend between both the concrete column 702 and the ground anchor 510. For example, reinforcing members 706 may be partially embedded in the concrete of the ground anchor 510 when the ground anchor 510 is formed. The exposed portions of the reinforcing members 706 may extend into the metal tube 700 and thus may be embedded in the concrete column 702 when the metal tube 700 is filled with concrete. As shown, the reinforcing members 706 extend vertically, but any suitable configuration of reinforcing members may be used, such as a lattice-like structure. In some cases, the reinforcing members 706 are interconnected (e.g., by other reinforcing members that extend between the reinforcing members 706).

Figure 8A:
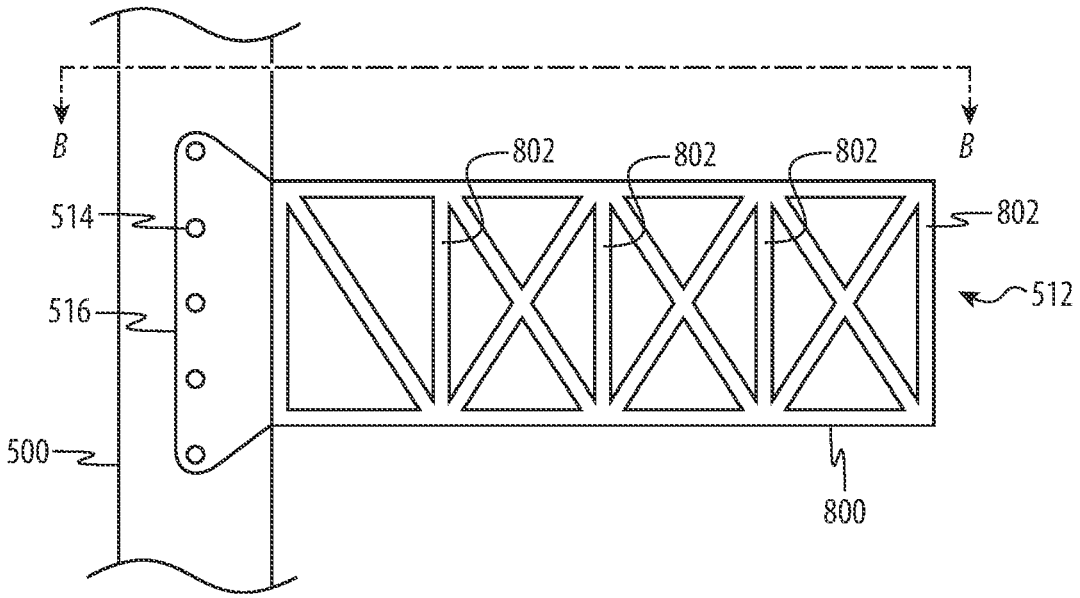
FIG. 8A depicts a side view of a bracket coupled to a pylon.
Figure 8B:
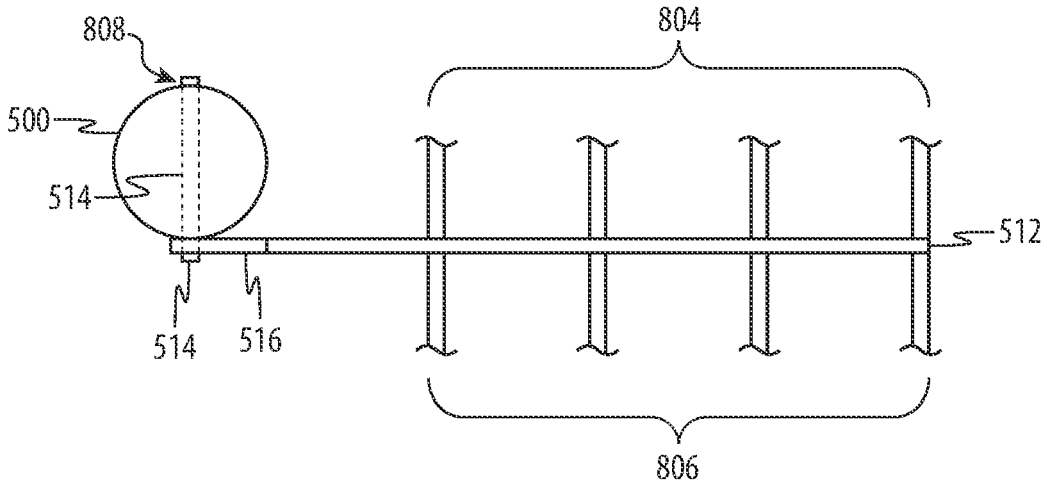
FIG. 8B depicts a side view of the bracket of FIG. 8A coupled to the pylon.

As noted above, the cantilevered road sections may be attached to the pylons via brackets 512 that are secured to the pylons. FIGS. 8A-8B depict the pylon 500 and the bracket 512 attached to the pylon 500. FIG. 8A shows the bracket 512 without attached road sections, while FIG. 8B is a view of the pylon 500 and bracket 512 viewed along line B-B in FIG. 8A. FIG. 8B further illustrates an example attachment configuration between the bracket 512 and joists of a road section.

The bracket 512 may include the mounting plate 516 and a cantilevered road support member 800 extending from the mounting plate 516. The mounting plate 516 is secured to the pylon via anchors 514. The mounting plate 516 and the cantilevered road support member 800 may be constructed of multiple metal members coupled together (e.g., via welding, fasteners, or the like). As another example, the mounting plate 516 and the cantilevered road support member 800 may be different segments of a single monolithic metal structure. Other materials may also be used instead of or in addition to metal (e.g., concrete). Further, while one example configuration of the bracket 512 is shown in FIGS. 8A-8B, other shapes and overall configurations are also contemplated. In some cases, the bracket 512 may include more, fewer, or different features, structures, reinforcements, brackets, mounting points, or the like.

The cantilevered road support member 800 may support the joists of one or more cantilevered road sections. For example, the cantilevered road support member 800 may define anchor points 802 to which the joists of the road sections are secured. FIG. 8B illustrates a partial cross-sectional top view of the pylon 500 and the cantilevered road support member 800, showing how joists 804 and 806 may be secured to the anchor points 802. The joists 804, 806 may be secured to the anchor points 802 in any suitable way. For example, the joists 804, 806 may be secured to the anchor points 802 via welds, bolts, fasteners, brackets, or any other suitable technique and/or structure. As another example, instead of the ends of the joists 804, 806 being cantilevered from the face of the cantilevered road support member 800, the joists 804, 806 may be positioned on top of the cantilevered road support member 800 (and secured via welds, bolts, fasteners, brackets, etc.).

FIG. 8B illustrates additional details of the anchors 514 that secure the bracket 512 to the pylon 500. As shown, the anchors 514 extend through the pylon 500. Where the pylons 500 include a concrete column inside of a metal tube, as described herein, the portions of the anchors 514 that are inside the pylon 500 may be at least partially encapsulated by the concrete column. The structural coupling between the anchors 514 and the pylon 500 may exhibit similar structural redundancy as the pylon 500 itself. For example, either the anchor-to-tube connection or the anchor-to-concrete connection may alone be sufficient to fully support the bracket 512

(and the attached road sections, even when loaded with vehicles). This redundancy is advantageous for reliability and durability of the elevated roadway, and also contributes to the ability to stage the installation and commissioning of the system by ensuring that the roadway can be fully and safely supported even without the concrete column in the pylons 500.

FIGS. 8A-8B illustrate one bracket 512 attached to the pylon 500. In some cases, additional brackets may be attached to the pylon 500. For example, an additional bracket may be attached to the side of the pylon 500 opposite the bracket 512 and anchored (at location 808) using the anchors 514. In cases where an additional bracket is used, each bracket may be directly coupled to the joists of only one road section (though the joists of the road sections may be coupled together between the two brackets).

Figure 9A:
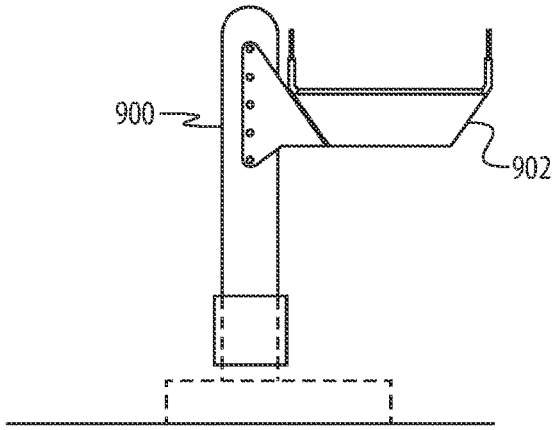
FIGS. 9A-9D depict example configurations of road sections supported by a pylon.

FIGS. 9A-9D depict several example configurations of road sections coupled to pylons, illustrating the flexibility and scalability of the elevated roadway design described herein. FIG. 9A shows a single cantilevered road section 902 coupled to a pylon 900. As described above, the cantilevered design allows the road section 902 to freely overhang the ground. This may improve installation flexibility, as the pylons need not be positioned directly below the center of the elevated roadway. Further, this configuration allows the entire width of the roadway to act as an awning over an unobstructed path. In contrast, pylons along the center of the roadway (e.g., directly in the middle) would interrupt the path beneath the roadway and limit its functionality as an awning for sidewalks, roads, bike paths, parks, rights-of-way, or the like. Further, the cantilevered design allows pylons to be positioned along a single side of the roadway. For example, a roadway may define a direction of vehicular travel (into the page in FIG. 9A, for example), and along at least a portion the roadway all of the pylons may be positioned along the side of the road sections. In some cases, different portions of the roadway have pylons along different sides. For example, some portion of the roadway shown in FIG. 9A may have pylons positioned along a right side of the road section 902.

Figure 9B:
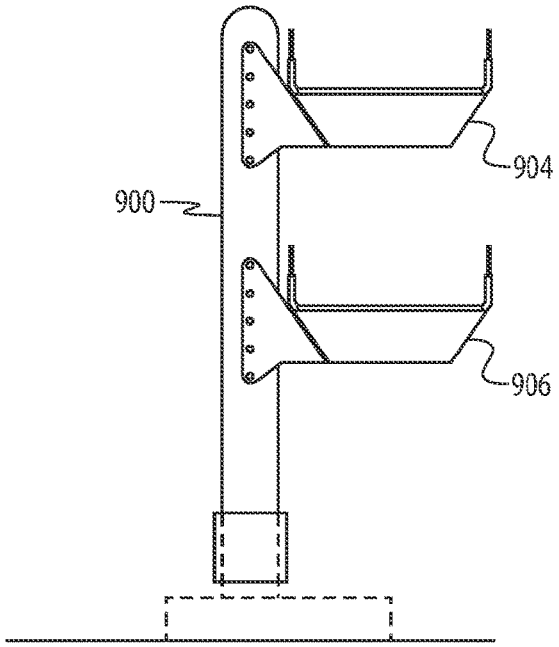
Figure 9C:
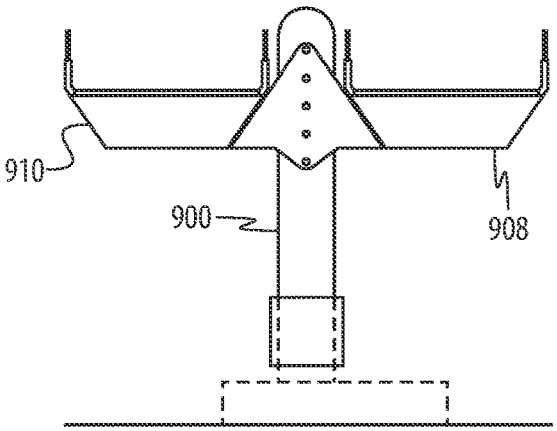
Figure 9D:
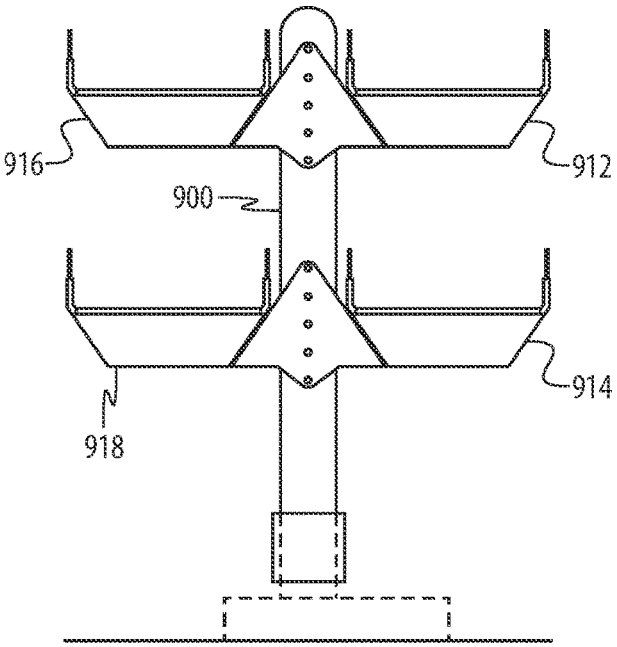

FIG. 9B shows a stacked configuration in which a first cantilevered road section 904 is coupled to the pylon 900 vertically above a second cantilevered road section 906. FIG. 9C shows a dual cantilever configuration in which a first cantilevered road section 908 is positioned on a first side of the pylon 900 and a second cantilevered road section 910 is positioned on an opposite side of the pylon 900. FIG. 9D shows a stacked dual cantilever configuration in which first and second cantilevered road sections 912, 914 are positioned on a same side of the pylon 900 (with the first section 912 positioned vertically above the second section 914), and third and fourth cantilevered road sections 916, 918 are positioned on an opposite side of the pylon 900 (with the third section 916 positioned vertically above the fourth section 918).

While the cantilevered road sections in FIGS. 9A-9D are all shown as parallel (e.g., defining parallel elevated roadways), multiple cantilevered road sections can be coupled to a single pylon in a non-parallel arrangement. For example, a pylon at a ninety-degree intersection of two elevated roadways may support multiple road sections. In some cases, multiple road sections may define a single-grade intersection where two elevated roadways join, or an overpass-type intersection where one roadway is above another non-parallel roadway. In either case, pylons may support one or multiple road sections using the structures and techniques shown and described herein.

FIGS. 10A-10F depict an example process for assembling an elevated roadway as described herein. This is merely one example process, and the process of assembling the roadway may include more or different operations, and/or the operations may be performed in a different order that that depicted in FIGS. 10A-10F.

At operation 1000 (FIG. 10A), a ground anchor 1011 is formed in the ground. The ground anchor 1011 may be formed of reinforced concrete or any other suitable material. Other underground features may also be constructed at this operation, including but not limited to storm drains utility vaults or chambers, underground water reservoirs, etc. Conduits may be formed in the ground anchor 1011 to communicate with conduits in a pylon.

At operation 1002 (FIG. 10B), a pylon 1012, or more particularly a metal tube of a pylon, is attached to the ground anchor 1011. The metal tube of the pylon 1012 may be bolted or otherwise fastened to the ground anchor 1011. Reinforcing members (e.g., rebar) may be positioned inside the hollow interior of the metal tube. Additionally, reinforcing members may extend out of the top of the ground anchor 1011 and may be positioned in the hollow interior of the metal tube, such that the reinforcing members will become encapsulated in a concrete column that is formed inside the metal tube.

At operation 1004 (FIG. 10C), the metal tube of the pylon 1012 is filled with concrete (indicated by arrow 1014). The concrete may be pumped into the metal tube from an inlet positioned proximate the bottom of the metal tube. Alternatively or additionally, the concrete may be poured in from an inlet proximate the top of the metal tube. In some cases, the metal tube defines an open top such that concrete may be poured in directly from the top opening. After the metal tube is filled with concrete, any openings may be sealed (e.g., by welding or otherwise securing caps onto the inlets and/or openings) to protect the concrete column. In some cases, operation 1004 may be delayed until after the road sections are raised and attached to the pylons, and even until after the elevated roadway system is otherwise fully operational.

Operations 1000-1004 illustrate the forming of a single ground anchor 1011 and pylon 1012, though other ground anchors and pylons may be formed at the same time or in series. As shown in operation 1008, multiple ground anchors 1011 and pylons 1012 may be erected before a road span is raised and secured to the pylons 1012.

Figure 10A:
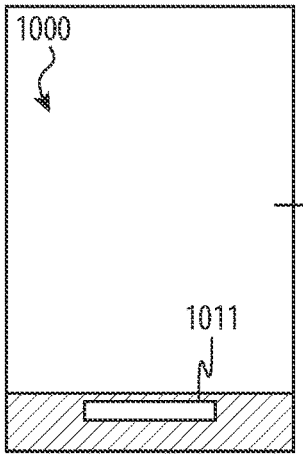
FIGS. 10A-10F depict steps of an example process for constructing an elevated roadway.
Figure 10B:
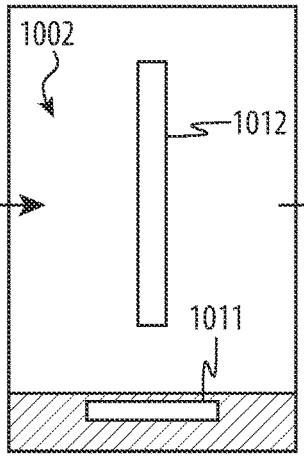
Figure 10C:
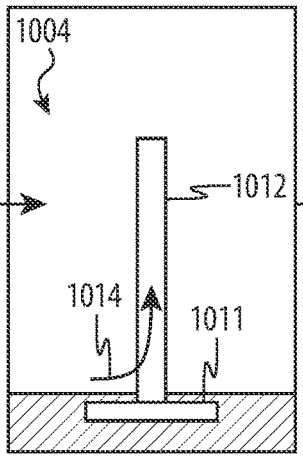
Figure 10D:
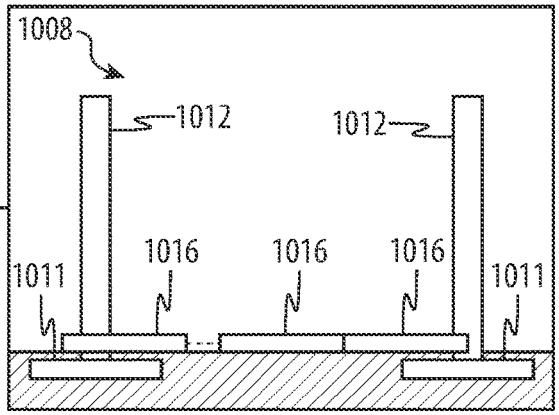
Figure 10E:
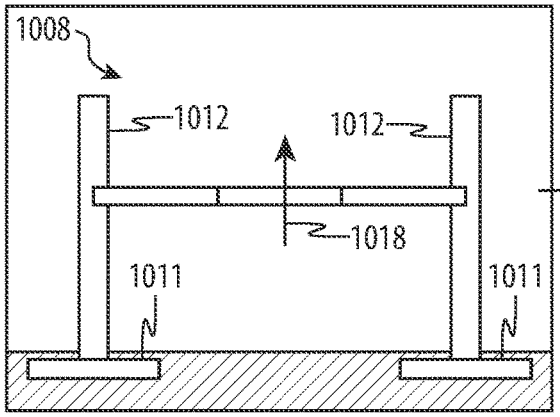
Figure 10F:
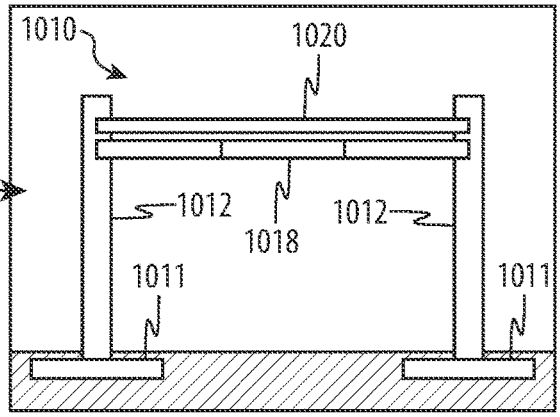

At operation 1008 (FIG. 10D), multiple joist structures 1016 may be constructed and joined to form a joist span 1018 (shown in FIG. 10E). This may include, for example, assembling joist structures from multiple joists and securing multiple joist structures together in an end-to-end configuration. The number of joist structures required may be determined, at least in part, based on the shipping constraints in the area where the roadway is being constructed. For example, for a 100-foot roadway span in a region where it is feasible to ship prefabricated 50-foot joists, the roadway span may include two joist structures. Where it is more feasible to ship prefabricated 33-foot joists, the roadway span may include three joist structures. For shorter roadway spans, fewer joist structures may be used. As noted above, joist structures for the elevated roadway may be largely standardized so that identical joist structures (and joists and other components of the joist structure) can be used for numerous road sections of the elevated roadway, thereby simplifying construction and increasing the speed of construction of the roadway.

Figure 11:
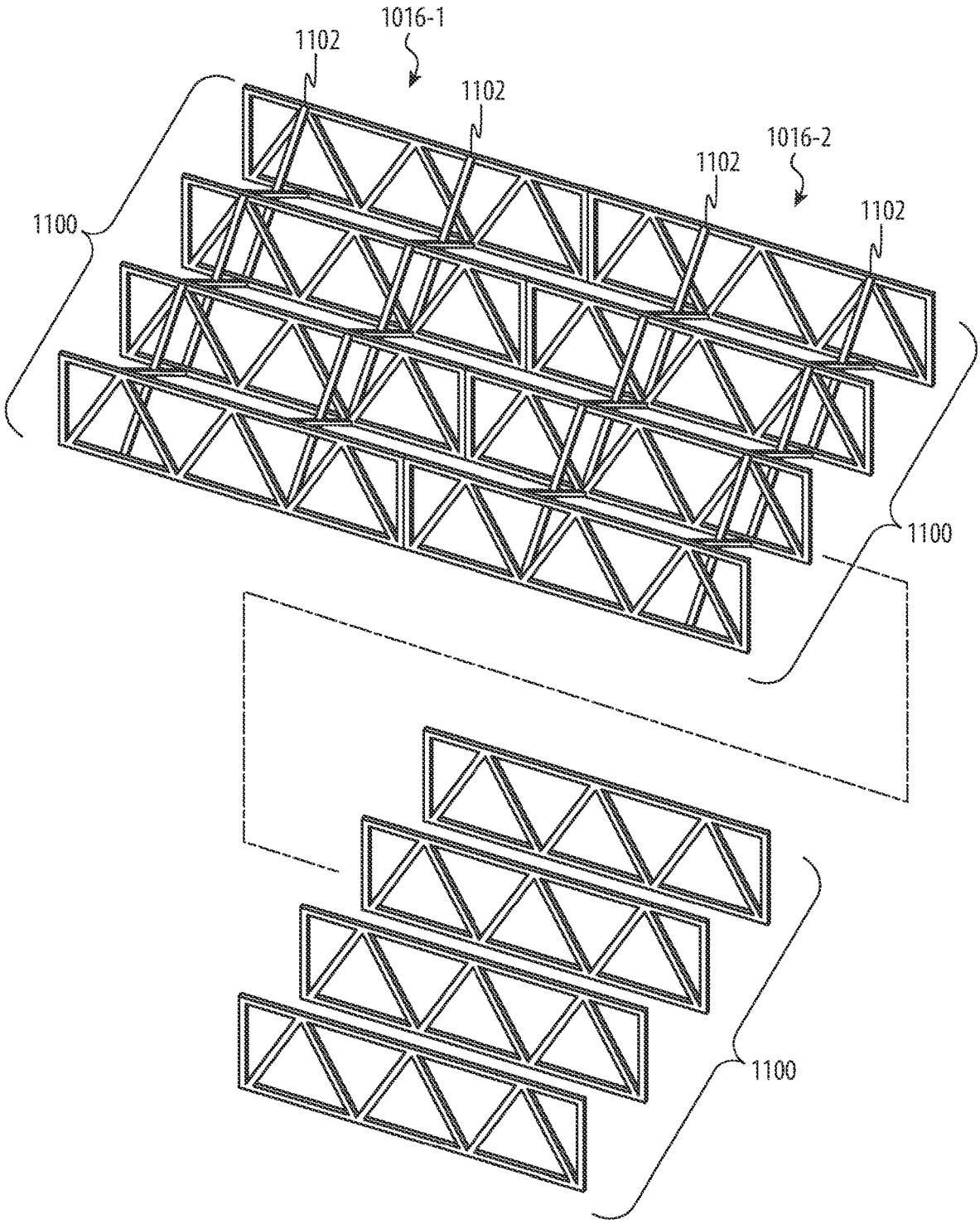
FIG. 11 depicts an example process for constructing joist structures.

FIG. 11 illustrates how multiple joist structures 1016 may be constructed and connected together to form a larger, integrated joist structure for the joist span 1018. As shown in FIG. 11, two joist structures 1016-1 and 1016-2 have been constructed from a plurality of joists 1100 (four, as shown) and inter-joist structures 1102. The inter-joist structures 1102 may include cables, beams, struts, bars, tubes, or any other suitable members or structures. The inter-joist structures 1102 may hold the joists 1100 together to form the joist structures 1016. Other structures may be used instead of or in addition to the inter-joist structures 1102 to hold the joists 1100 together and define a rigidly interconnected joist structure. The two joist structures 1016-1 and 1016-2 have been coupled end-to-end to define part of the joist span 1018. Welds, brackets, fasteners, or any other suitable components or techniques may be used to form the end-to-end couplings between joist structures and/or individual joists. In cases where a first joist structure is coupled end-to-end with a second joist structure, the joists of the first joist structure may at least partially overlap the joists of the second joist structure.

Returning to FIG. 10D, at operation 1008, the joist span 1018 (formed of any number of joist sections, as described herein) may be raised and coupled to one or more pylons. For example, the joist span 1018 may be raised using one or more cranes, jack systems, or any other suitable technique, and then the joist span 1018 may be coupled to the pylons 1012 via brackets, as described herein. In some cases, the coupling of joist structures (as shown in FIG. 11, for example) may occur while the joist structures are raised or elevated. For example, a first joist structure may be coupled to a pylon 1012, and another joist structure may be raised to meet and be coupled to the first joist structure.

At operation 1010 (FIG. 10F), a road structure 1020 may be constructed on top of the joist span 1018. Constructing the road structure 1020 may include coupling forms to the joist structures and filling the forms with reinforced concrete to define a road member, road supports, and side walls (shown and described with respect to FIGS. 2-4B). The forms may be filled using a concrete placing or paving machine that fills the forms and defines a smooth wearing surface along the top of the road member. The concrete placing or paving machine may be at least partially automated and may be able to form the road structure 1020 according to a predetermined computer model. For example, the concrete placing or paving machine may adjust parameters such as the thickness of the road member, a height of the road member above the joist structure, or other parameters, in order to produce the target road structure configuration. As noted herein, the target road structure configuration may have a shape that produces a target ride characteristic for a vehicle passenger, and the concrete placing or paving machine may produce the roadway according to that shape. The concrete placing or paving machine may use highly accurate positioning systems and techniques to ensure that the position and shape of the road structure 1020 corresponds to the predetermined computer model. For example, the concrete placing or paving machine may use differential global positioning system (e.g., Differential GPS or DGPS) to establish its location and ensure the correct location, position, and shape of the road structure 1020.

Other construction operations may be performed before, during, or after the operations shown and described with respect to FIGS. 10A-10F. For example, fencing may be constructed along the roadway, conduits for water, wiring, or other utilities may be fitted to the roadway (e.g., within the joist structures), and other equipment may be fitted to the roadway to facilitate operation of the vehicles.

As noted above, the elevated roadway described herein may be used with a transportation system in which numerous vehicles may be autonomously operated to transport passengers and/or freight along the elevated roadway. For example, a transportation system or service may provide a fleet of vehicles that operate along the elevated roadway. Vehicles in such a transportation system may be configured to operate autonomously. As used herein, the term "autonomous" may refer to a mode or scheme in which vehicles can operate without continuous, manual control by a human operator. For example, driverless vehicles may navigate along a roadway, including elevated roadways as those described above, using a system of sensors that guide the vehicle, and a system of automatic drive and steering mechanisms that control the speed and direction of the vehicle. In some cases, the vehicles may not require steering, speed, or directional control from the passengers, and may exclude controls such as passenger-accessible accelerator and brake pedals, steering wheels, and other manual controls. In some cases, the vehicles may include manual drive controls that may be used for maintenance, emergency overrides, or the like. Such controls may be hidden, stowed, or otherwise not directly accessible by a user during normal vehicle operation. For example, they may be designed to be accessed only by trained operators, maintenance personnel, or the like.

Autonomous operation need not exclude all human or manual operation of the vehicles or of the transportation system as a whole. For example, human operators may be able to intervene in the operation of a vehicle for safety, convenience, testing, or other purposes. Such intervention may be local to the vehicle, such as when a human driver takes controls of the vehicle, or remotely, such as when an operator sends commands to the vehicle via a remote control system. Similarly, some aspects of the vehicles may be controlled by passengers of the vehicles. For example, a passenger in a vehicle may select a target destination, a route, a speed, control the operation of the doors and/or windows, or the like. Accordingly, it will be understood that the terms "autonomous" and "autonomous operation" do not necessarily exclude all human intervention or operation of the individual vehicles or of the overall transportation system.

The vehicles in an autonomous transportation system as described herein may be operated on a fully public roadway, or on a closed roadway (which may include surface segments and elevated segments, as described above). A closed roadway may be customized for the operation of the system-specific vehicles and the transportation system as a whole. For example, the roadway may have markers, signs, fiducials, or other objects or components on, in, or proximate the roadway to help the vehicles operate. For example, vehicles may include sensors that can sense magnetic markers that are embedded in the road member to help guide the vehicles and allow the vehicles to determine their location, speed, orientation, or the like. As another example, the roadway may have signs or other indicators that can be detected by cameras on the vehicle and that provide information such as location, speed limit, traffic flow patterns, and the like.

The vehicles in the transportation system may include various sensors, cameras, communications systems, processors, and/or other components or systems that help facilitate autonomous operation. For example, the vehicles may include a sensor array that detects magnets or other markers embedded in the road member and which help the vehicle determine its location, position, and/or orientation on the roadway. The vehicles may also include wireless vehicleto-vehicle communications systems, such as optical communications systems, that allow the vehicles to inform one another of operational parameters such as their braking status, acceleration status, their next maneuver (e.g., right turn, left turn, planned stop), their number or type of payload (e.g., humans or freight), or the like. The vehicles may also include wireless communications systems to facilitate communication with a central operations system that has supervisory command and control authority over the transportation system.

The vehicles in the transportation system may be designed to enhance the operation and convenience of the transportation system. For example, a primary purpose of the transportation system may be to provide comfortable, convenient, rapid, and efficient personal transportation. To provide personal comfort, the vehicles may be designed for easy passenger ingress and egress, and may have comfortable seating arrangements with generous legroom and headroom. The vehicles may also have a sophisticated suspension system that provides a comfortable ride and dynamically adjustable parameters to help keep the vehicle level, positioned at a convenient height, and to ensure a comfortable ride throughout a range of variable load weights.

Conventional personal automobiles are designed for operation primarily in only one direction. This is due in part to the fact that drivers are oriented forwards, and operating in reverse for long distances is generally not safe or necessary. However, in autonomous vehicles, where humans are not directly controlling the operation of the vehicle in real-time, it may be advantageous for a vehicle to be able to operate bidirectionally. For example, the vehicles in a transportation system as described herein may be substantially symmetrical, such that the vehicles lack a visually or mechanically distinct front or back. Further, the wheels may be controlled sufficiently independently so that the vehicle may operate substantially identically no matter which end of the vehicle is facing the direction of travel. This symmetrical design provides several advantages. For example, the vehicle may be able to maneuver in smaller spaces by potentially eliminating the need to make U-turns or other maneuvers to re-orient the vehicles so that they are facing "forward" before initiating a journey.

Figure 12A:
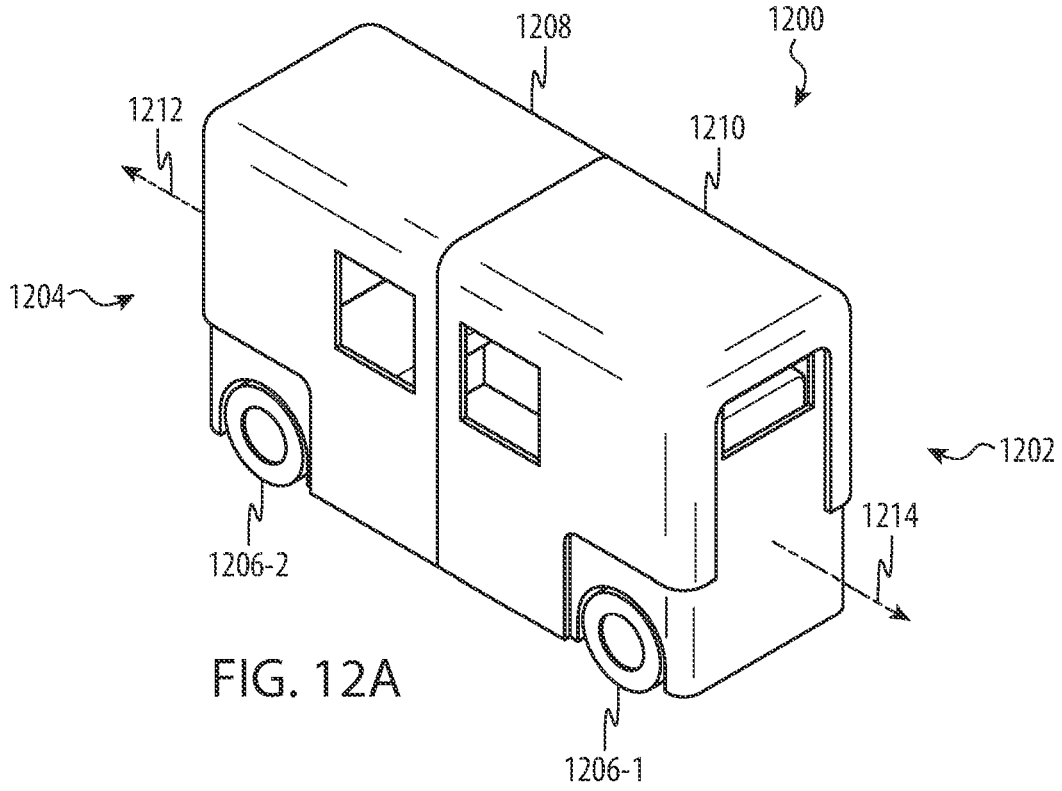
FIGS. 12A-12B depict an example vehicle.
Figure 12B:
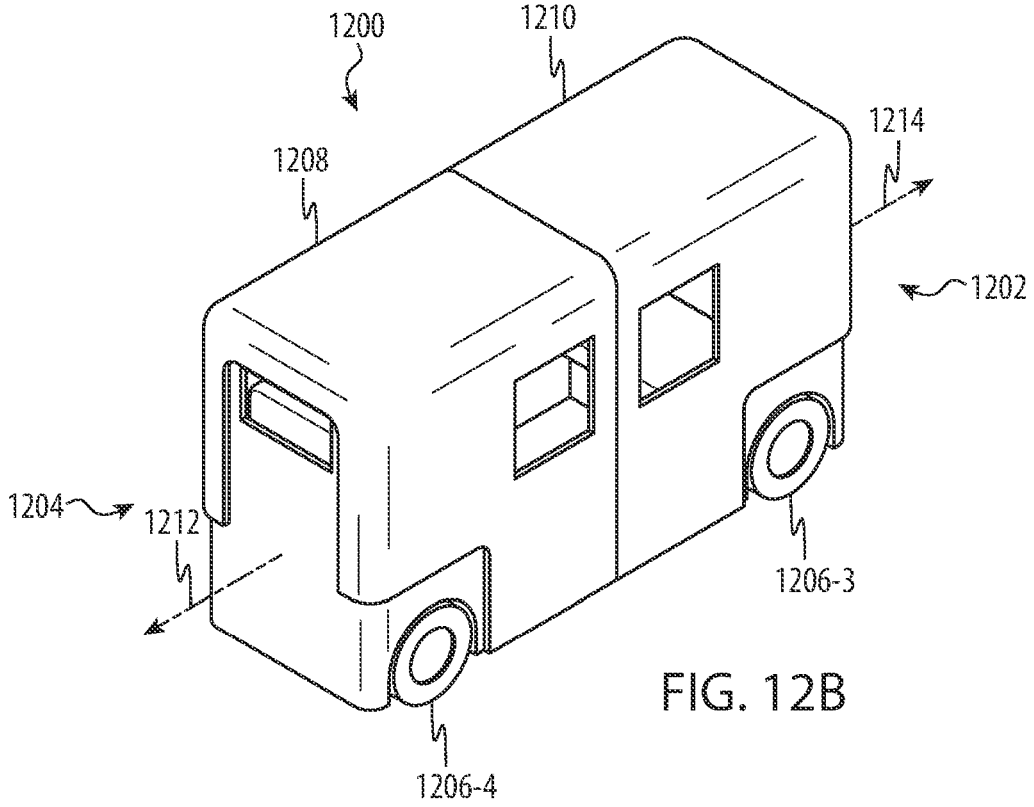

FIGS. 12A and 12B are perspective views of an example four-wheeled roadway vehicle 1200 (referred to herein simply as a "vehicle") that may be used in a transportation system as described herein. FIGS. 12A-12B illustrate the symmetry and bidirectionality of the vehicle 1200. In particular, the vehicle 1200 defines a first end 1202, shown in the forefront in FIG. 12A, and a second end 1204, shown in the forefront in FIG. 12B. In some examples and as shown, the first and second ends 1202, 1204 are substantially identical. Moreover, the vehicle 1200 may be configured so that it can be driven with either end facing the direction of travel. For example, when the vehicle 1200 is travelling in the direction indicated by arrow 1214, the first end 1202 is the leading end of the vehicle 1200, while when the vehicle 1200 is traveling in the direction indicated by arrow 1212, the second end 1204 is the leading end of the vehicle 1200.

The vehicle 1200 may also include wheels 1206 (e.g., wheels 1206-1-1206-4). The wheels 1206 may be paired according to their proximity to an end of the vehicle. Thus, wheels 1206-1, 1206-3 may be positioned proximate the first end 1202 of the vehicle and may be referred to as a first pair of wheels 1206, and the wheels 1206-2, 1206-4 may be positioned proximate the second end 1204 of the vehicle and may be referred to as a second pair of wheels 1206. Each pair of wheels may be driven by at least one motor (e.g., an electric motor), and each pair of wheels may be able to steer the vehicle. Because each pair of wheels is capable of turning to steer the vehicle, the vehicle may have similar driving and handling characteristics regardless of the direction of travel. In some cases, the vehicle may be operated in a two-wheel steering mode, in which only one pair of wheels steers the vehicle 1200 at a given time. In such cases, the particular pair of wheels that steers the vehicle 1200 may change when the direction of travel changes. In other cases, the vehicle may be operated in a four-wheel steering mode, in which the wheels are operated in concert to steer the vehicle. In a four-wheel steering mode, the pairs of wheels may either turn in the same direction or in opposite directions, depending on the steering maneuver being performed and/or the speed of the vehicle.

The vehicle 1200 may also include doors 1208, 1210 that open to allow passengers and other payloads (e.g., packages, luggage, freight) to be placed inside the vehicle 1200. The doors 1208, 1210, which are described in greater detail herein, may extend over the top of the vehicle such that they each define two opposite side segments. For example, each door defines a side segment on a first side of the vehicle and another side segment on a second, opposite side of the vehicle. The doors also each define a roof segment that extends between the side segments and defines part of the roof (or top side) of the vehicle. In some cases, the doors 1208, 1210 resemble an upside-down "U" in cross-section and may be referred to as canopy doors. The side segments and the roof segment of the doors may be formed as a rigid structural unit, such that all of the components of the door (e.g., the side segments and the roof segment) move in concert with one another. In some cases, the doors 1208, 1210 include a unitary shell or door chassis that is formed from a monolithic structure. The unitary shell or door chassis may be formed from a composite sheet or structure including, for example, fiberglass, carbon composite, and/or other lightweight composite materials.

Figure 13A:
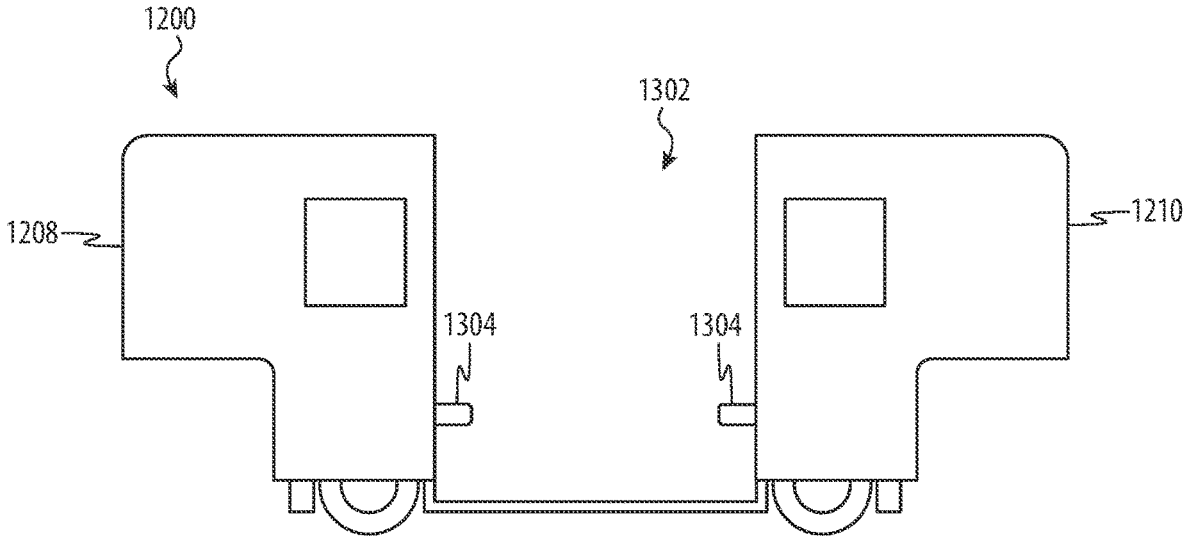
FIGS. 13A-13B depict the vehicle of FIGS. 12A-12B with its doors open.
Figure 13B:
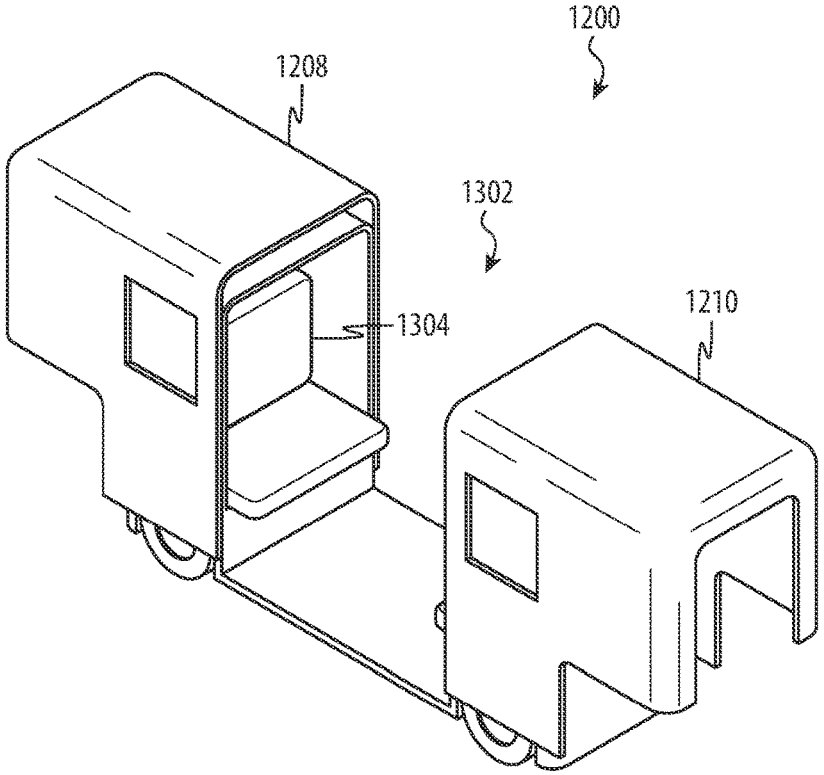

FIGS. 13A and 13B are side and perspective views of the vehicle 1200 with the doors 1208, 1210 in an open state. Because the doors 1208, 1210 each define two opposite side segments and a roof segment, an uninterrupted internal space 1302 may be revealed when the doors 1208, 1210 are opened. In the example depicted in FIGS. 13A and 13B, when the doors 1208, 1210 are opened, an open section may be defined between the doors 1208, 1210 that extends from one side of the vehicle 1200 to the other. This may allow for unimpeded ingress and egress into the vehicle 1200 by passengers on either side of the vehicle 1200. The lack of an overhead structure when the doors 1208, 1210 are opened may allow passengers to walk across the vehicle 1200 without a limit on the overhead clearance.

The vehicle 1200 may also include seats 1304, which may be positioned at opposite ends of the vehicle 1200 and may be facing one another. As shown, the vehicle includes two seats 1304, though other numbers of seats and other arrangements of seats are also possible (e.g., zero seats, one seat, three seats, etc.). In some cases, the seats 1304 may be removed, collapsed, or stowed so that wheelchairs, strollers, bicycles, or luggage may be more easily placed in the vehicle 1200.

Figure 14A:
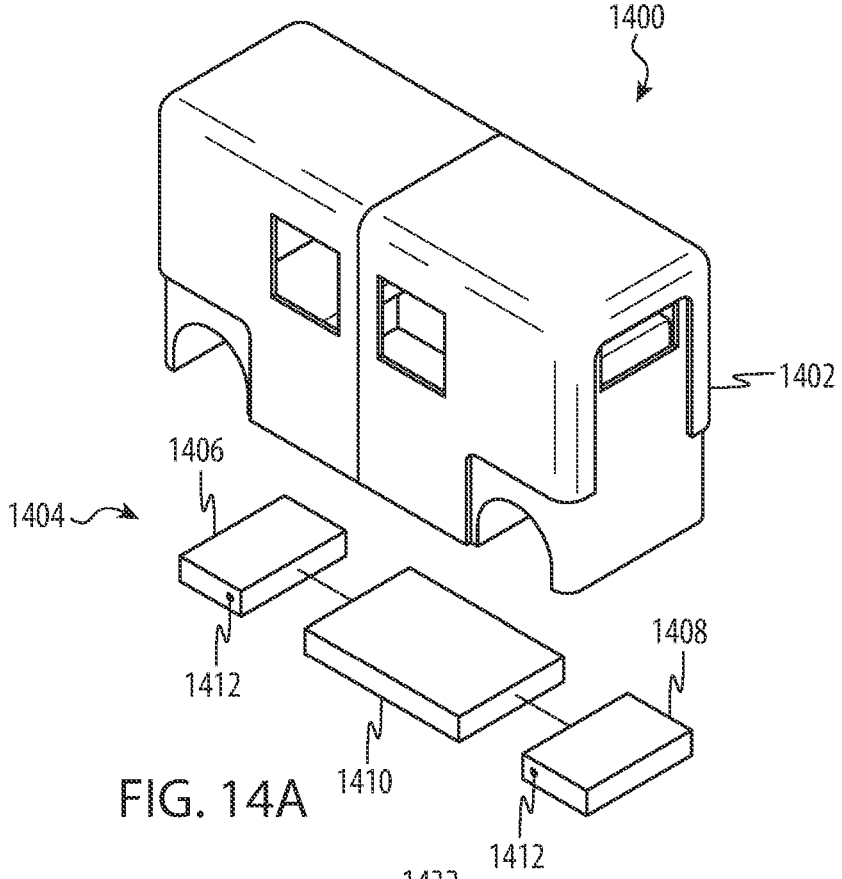
FIG. 14A depicts a partial exploded view of an example vehicle.
Figure 14B:
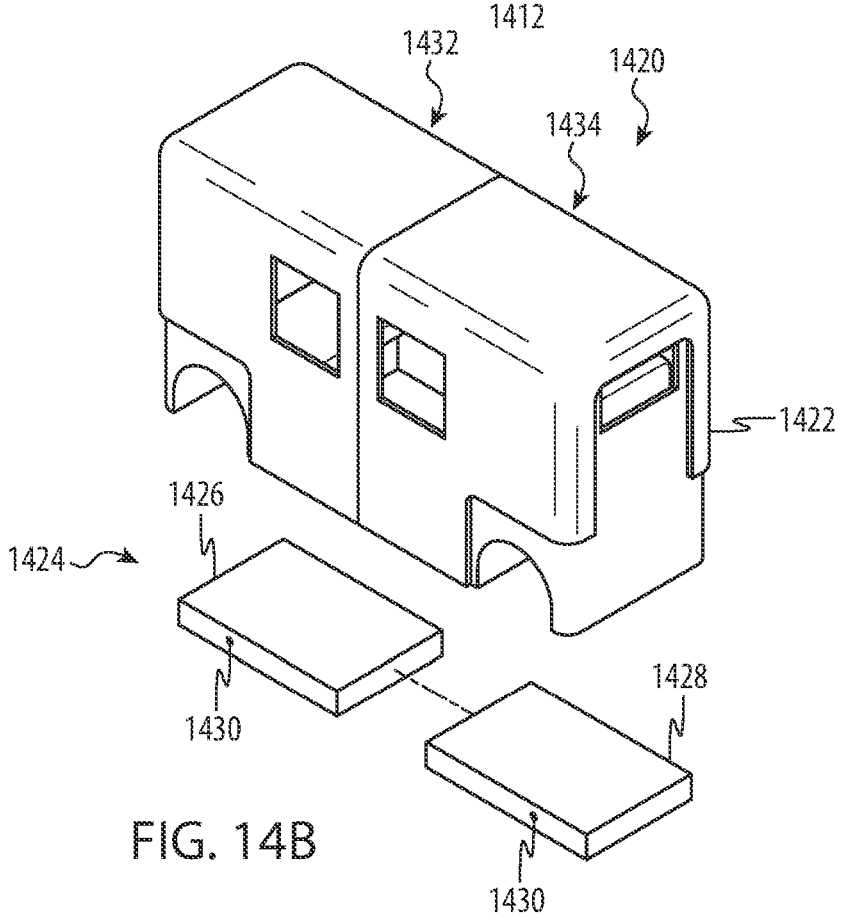
FIG. 14B depicts a partial exploded view of another example vehicle.

Vehicles for use in a transportation system as described herein, such as the vehicle 1200, may be designed for safe and comfortable operation, as well as for ease of manufacture and maintenance. To achieve these advantages, the vehicles may be designed to have a frame structure that includes many of the structural and operational components of the vehicle (e.g., the motor, suspension, batteries, etc.)

and that is positioned low to the ground. A body structure may be attached or secured to the frame structure. FIGS. 14A-14B illustrate partial exploded views of vehicles, which may be embodiments of the vehicle 1200, showing example configurations of a frame structure and body structure. As described below, the low position of the frame structure combined with the relatively lightweight body structure produces a vehicle with a very low center of gravity, which increases the safety and handling of the vehicle. For example, a low center of gravity reduces the rollover risk of the vehicle when the vehicle encounters slanted road surfaces, wind loading, sharp turns, or the like, and also reduces body roll of the vehicle during turning or other maneuvers. Further, by positioning many of the operational components of the vehicle, such as motors, batteries, control systems, sensors (e.g., sensors that detect road-mounted magnets or other markers), and the like, on the frame structure, manufacture and repair may be simplified.

FIG. 14A is a partial exploded view of a vehicle 1400, which may be an embodiment of the vehicle 1200. Details of the vehicle 1200 may be equally applicable to the vehicle 1400, and will not be repeated here. The vehicle 1400 may include a body structure 1402, which may include doors (e.g., the doors 1208, 1210, described above) and other body components, and a frame structure 1404 to which the body structure 1402 is attached.

The frame structure 1404 may be formed by coupling together several structural components. For example, FIG. 14A shows a frame structure 1404 that includes a base module 1410 and first and second wheel modules 1406, 1408. The wheel modules 1406, 1408 may be the same or similar to one another, and may in fact be interchangeable with one another. In this way, assembly and repair may be simplified as wheel modules may be replaced and/or swapped easily and quickly, and fewer unique replacement parts may be necessary to produce and/or store.

The wheel modules 1406, 1408 may include drive, suspension, and steering components of the vehicle. For example, the wheel modules may include wheel suspension systems (which may define or include wheel mounts, axles, or hubs, represented in FIG. 14A as points 1412), steering systems, drive motors, and optionally motor controllers. Wheels may be mounted to the wheel suspension systems via the wheel mounts, axles, hubs or the like. The drive motors may include one or more drive motors that drive the wheels, either independently or in concert with one another. The drive motors may receive power from a power source (e.g., battery) that is mounted on the base module 1410. Motor controllers for the drive motors may also be mounted on the wheel modules 1406, 1408, or they may be mounted on the base module 1410.

The suspension systems may be any suitable type of suspension system. In some cases, the suspension systems include independent suspension systems for each wheel. For example, the suspension systems may be double-wishbone torsion-bar suspension systems. The suspension systems may also be dynamically adjustable, such as to control the ride height, suspension preload, damping, or other suspension parameters while the vehicle is stationary or while it is moving. Other suspension systems are also contemplated, such as swing axle suspension, sliding pillar suspension, MacPherson strut suspension, or the like. Moreover, spring and damping functions may be provided by any suitable component or system, such as coil springs, leaf springs, pneumatic springs, hydropneumatic springs, magneto-rheological shock absorbers, and the like. The suspension systems may be configured to operate in conjunction with the contour of a road surface (e.g., of an elevated roadway as described above) to maintain a desired experience for a passenger.

The wheel modules 1406, 1408 may also include steering systems that allow the wheels to be turned to steer the vehicle. In some cases the wheels may be independently steerable, or they may be linked (e.g., via a steering rack) so that they always point in substantially the same direction during normal operation of the vehicle. As noted above, because each pair of wheels is steerable, either wheel module 1406, 1408 may be the leading or trailing wheel module at a given time. Further, this allows the vehicles to use four-wheel steering schemes, as well as to alternate between two-wheel steering and four-wheel steering schemes.

The base module 1410 may include components such as batteries, motors and mechanisms for opening and closing the vehicle's doors, control systems (including computers or other processing units), and the like. The wheel modules 1406, 1408 may be attached to the base module 1410 in a secure manner, such as via bolts or other fasteners, interlocking structures, rivets, welds, or the like. In some cases, the wheel modules 1406, 1408 are removable from the base module 1410 in a non-destructive manner (e.g., without having to cut weldments or metal or otherwise damage the structural material of the module) so that the modules may be replaced or disassembled from one another for ease of service or repair. For example, the wheel modules 1406, 1408 may be removably attached to the base module 1410 using one or more threaded fasteners or pins.

FIG. 14B is a partial exploded view of a vehicle 1420, which may be an embodiment of the vehicle 1200. Details of the vehicle 1200 may be equally applicable to the vehicle 1420, and will not be repeated here. The vehicle 1420 may include a body structure 1422, which may include doors (e.g., the doors 1208, 1210, described above) and other body components, and a frame structure 1424 to which the body structure 1422 is attached.

Whereas the frame structure 1404 in FIG. 14A included a base module and two wheel modules, the frame structure 1424 in FIG. 14B includes two wheel modules 1426, 1428 and no separate base module. The wheel modules 1426, 1428 may include all of the components of the wheel modules 1406, 1408 in FIG. 14B, but may also include components that were coupled to or otherwise integrated with the base module 1410. For example, each wheel module 1426, 1428 may include wheel suspension (which may include wheel mounts or axles, illustrated in FIG. 14B as points 1430), steering systems, drive motors, and motor controllers.

The wheel modules 1426, 1428 may also include batteries, control systems (including computers or other processing units), motors and mechanisms for opening and closing the vehicle's doors, and the like. In some cases, components of the wheel modules 1426, 1428 may be configured to be backup or redundant components. For example, each wheel module 1426, 1428 may include a control system that is capable of controlling all of the operations of the vehicle, including controlling the components and mechanisms of its own wheel module as well as those of the other wheel module of the frame structure 1424. Accordingly, if one control system malfunctions or fails, the other control system on the other wheel module may seamlessly assume operation of the vehicle.

The wheel modules 1426, 1428 may be attached to one another in a secure manner, such as via bolts or other fasteners, interlocking structures, rivets, welds, or the like.

In some cases, the wheel modules 1426, 1428 are removable from one another in a non-destructive manner (e.g., without having to cut weldments or metal or otherwise damage the structural material of the module) so that the modules may be replaced or disassembled from one another for ease of service or repair. For example, the wheel modules 1426, 1428 may be removably attached to the base module 1410 using one or more threaded fasteners or pins.

While the body structure 1422 is shown in FIG. 14B as separate from the frame structure 1424, other embodiments may integrate the body structure 1422 with the frame structure 1424. For example, the body structure 1422 may have a first segment 1432 and a second segment 1434, which may be structurally coupled to the wheel modules 1426, 1428, respectively. In this way, structural components of the body structure 1422 and the frame structure 1424 that require or benefit from precise alignment may be assembled to a common substructure, thereby reducing misalignment between those components. For example, as described herein, door mechanisms may include a four-bar linkage with one pivot positioned on the first body segment 1432, and another pivot positioned on or near the wheel module 1426 (e.g., the wheel module directly below that body segment). By building the first body segment 1432 to the underlying wheel module 1426, the relative position between these pivots may be more tightly controlled allowing for more predictable or reliable operation of the door mechanism. Additionally, in many cases the alignment between the first and second segments 1432, 1434 of the body structure 1422 may be less important than the alignment between a given segment of the body structure 1422 and the underlying wheel module. Accordingly, integrating separate segments of the body structure 1422 with separate wheel modules may improve the tolerances and alignment of the components of the vehicle.

FIGS. 14A-14B illustrate example configurations of vehicles and frame structures. Other configurations are also possible, however. Moreover, the frame structures and the body structures shown in FIGS. 14A-14B are intended more as schematic representations of these components, and these components may include other structures that are omitted from FIGS. 14A-14B for clarity. Additional structural connections and integrations may be made between the body structures and the frame structures than are explicitly represented in FIGS. 14A-14B. For example, components a door mechanism that open and close the doors of the body structures may be joined to both the doors and to the frame structures.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings. For example, while the methods or processes disclosed herein have been described and shown with reference to particular operations performed in a particular order, these operations may be combined, subdivided, or re-ordered to form equivalent methods or processes without departing from the teachings of the present disclosure. Moreover, structures, features, components, materials, steps, processes, or the like, that are described herein with respect to one embodiment may be omitted from that embodiment or incorporated into other embodiments. Further, while the term "roadway" is used herein to refer to structures that support moving vehicles, the elevated roadway described herein does not necessarily conform to any definition, standard, or requirement that may be associated with the term "roadway," such as may be used in laws, regulations, transportation codes, or the like. As such, the elevated roadway described herein is not necessarily required to (and indeed may not) provide the same features and/or structures of a conventional "roadway." Of course, the elevated roadways described herein may comply with any and all applicable laws, safety regulations, or other rules for the safety of passengers, bystanders, operators, builders, maintenance personnel, or the like.

What is claimed is:

1. An elevated roadway structure for autonomous vehicles, comprising:
- a plurality of pylons, each respective pylon of the plurality of pylons extending vertically from a respective ground anchor; and
- a roadway supported by the plurality of pylons and comprising:
  - a road section coupled to at least one pylon of the plurality of pylons and comprising:
    - a joist structure; and
    - a unitary concrete structure positioned on the joist structure and defining:
      - a road member;
      - a plurality of road supports extending from the road member and configured to transfer load from the road member to the joist structure;
      - a first side barrier extending along a first side of the road member; and
      - a second side barrier extending along a second side of the road member.

2. The elevated roadway structure of claim 1, wherein the unitary concrete structure is formed of a molded reinforced concrete.

3. The elevated roadway structure of claim 1, further comprising a bracket coupled to a pylon of the plurality of pylons and supporting the road section.

4. The elevated roadway structure of claim 3, wherein a top of the joist structure is substantially even with a top of the bracket.

5. The elevated roadway structure of claim 3, wherein the joist structure is coupled to a top side of the bracket.

6. The elevated roadway structure of claim 3, wherein the bracket is anchored to the pylon along a single side of the pylon.

7. The elevated roadway structure of claim 1, wherein:
- the road section further comprises a metal form coupled to the joist structure; and
- a shape of the road member and the plurality of road supports are defined by the metal form.

8. The elevated roadway structure of claim 1, wherein:
- the joist structure comprises a plurality of parallel joists; and
- each respective road support of the plurality of road supports is supported by a respective joist of the plurality of parallel joists.

9. An elevated roadway structure for autonomous vehicles, comprising:
- a plurality of pylons; and
- a roadway supported above ground by the plurality of pylons, the roadway comprising:
  - a first road section comprising:

a first joist structure; and a first unitary concrete structure comprising:

a first road member; and a first set of road supports extending from the first road member and supported by the first joist structure; and a second road section coupled to the first road section to define a contiguous portion of the roadway, the second road section comprising:

a second joist structure; and a second unitary concrete structure comprising:

a second road member; and a second set of road supports extending from the second road member and supported by the second joist structure.

10. The elevated roadway structure of claim 9, wherein:

the first road member defines a first wearing surface that is substantially horizontal; and the second road member defines a second wearing surface that is pitched.

11. The elevated roadway structure of claim 10, wherein:

the road supports of the first set of road supports are substantially equal in height; and the road supports of the second set of road supports have different heights.

12. The elevated roadway structure of claim 10, wherein a top the second wearing surface is banked and defines a portion of a banked turn.

13. The elevated roadway structure of claim 9, wherein:

the elevated roadway structure further comprises a metal bracket coupled to a pylon of the plurality of pylons; and the first joist structure comprises a set of parallel metal joists, wherein a metal joist of the set of parallel metal joists is welded to the metal bracket at an end of the metal joist.

* * * * *